US006456281B1

(12) United States Patent
Rindal

(10) Patent No.: US 6,456,281 B1
(45) Date of Patent: Sep. 24, 2002

(54) METHOD AND APPARATUS FOR SELECTIVE ENABLING OF ADDRESSABLE DISPLAY ELEMENTS

(75) Inventor: Abraham Rindal, Castro Valley, CA (US)

(73) Assignee: Sun Microsystems, Inc., Palo Alto, CA (US)

( * ) Notice: Subject to any disclaimer, the term of this patent is extended or adjusted under 35 U.S.C. 154(b) by 0 days.

(21) Appl. No.: 09/285,487

(22) Filed: Apr. 2, 1999

(51) Int. Cl.[7] ..... G09G 5/00; G09G 3/36

(52) U.S. Cl. ..... 345/204; 345/98; 345/100

(58) Field of Search ..... 345/55, 60, 76, 345/80, 87, 94, 98, 99, 100, 204, 208, 214, 215; 377/57, 64, 73, 76, 81; 365/189.12, 240

(56) References Cited

U.S. PATENT DOCUMENTS

| | | | | |
|---|---|---|---|---|
| 3,626,244 A | * | 12/1971 | Holz | 315/161 |
| 3,740,577 A | * | 6/1973 | Sangster | 327/271 |
| 3,967,253 A | * | 6/1976 | Tsuruishi | 345/100 |
| 4,543,572 A | | 9/1985 | Tanaka et al. | 340/723 |
| 4,636,788 A | * | 1/1987 | Hilbrink | 345/91 |
| 4,641,135 A | * | 2/1987 | Hilbrink | 345/91 |
| 4,775,861 A | | 10/1988 | Saito | 340/784 |
| 5,233,339 A | * | 8/1993 | Newman et al. | 345/212 |
| 5,396,527 A | * | 3/1995 | Schlecht et al. | 257/235 |
| 5,436,635 A | | 7/1995 | Takahara et al. | 345/92 |
| 5,519,414 A | | 5/1996 | Gold et al. | 345/208 |
| 5,583,527 A | | 12/1996 | Fujisaki et al. | 345/55 |
| 5,619,225 A | | 4/1997 | Hashimoto | 345/98 |
| 5,754,151 A | * | 5/1998 | Moon | 345/87 |
| 5,847,516 A | * | 12/1998 | Kishita et al. | 315/169.1 |
| 5,874,828 A | * | 2/1999 | Lee | 323/274 |
| 5,977,961 A | | 11/1999 | Rindal | 345/208 |
| 6,157,375 A | | 12/2000 | Rindal et al. | 345/208 |

FOREIGN PATENT DOCUMENTS

| | | |
|---|---|---|
| DE | 27 48 149 A1 | 5/1979 |
| EP | 0 814 454 | 12/1997 |
| WO | 96/15519 | 5/1996 |

OTHER PUBLICATIONS

International Search Report, Application No. PCT/US 00/08609, mailed Aug. 3, 2000.

* cited by examiner

*Primary Examiner*—Bipin Shalwala
*Assistant Examiner*—Jeff Piziali
(74) *Attorney, Agent, or Firm*—Conley, Rose & Tayon, PC; Robert C. Kowert

(57) ABSTRACT

A method and apparatus for driving a plurality of addressable elements consist of driving and selectively enabling one or more addressable elements arranged as an M×N array using two drivers. The columns may be addressed in parallel. Columns may be coupled to a conductor by a charge transfer/isolation circuit. A voltage waveform or pulse train may be propagated down the display conductor such that a pulse is present on the display conductor for each element of a row of elements to be addressed. When the beginning of the pulse train has propagated to the last column tap-off point so that a different pulse is present at each column tap-off point corresponding to the row of elements to be selected, a corresponding charge is transferred to each column conductor in parallel. Thus, a voltage is supplied to select each element on the selected row as determined by the state of the pulse train at each column tap-off point. During the time the voltages are supplied to the column conductors, the column conductors are isolated from the column tap-off points so that a next pulse train corresponding to the next element row may be propagated down the conductor. The rows may be selected by any row addressing technique, such as individual row drivers, or a beat-frequency technique employing only two row drivers.

24 Claims, 30 Drawing Sheets

METHOD AND APPARATUS FOR SELECTIVE ENABLING OF ADDRESSABLE DISPLAY ELEMENTS

FIELD OF THE INVENTION

This invention relates to addressing of pixels arranged in an array format for displaying applications, and more particularly to driving pixel address lines in a video display.

BACKGROUND OF THE INVENTION

Addressable components that can be arranged in rows and columns are commonly found in applications ranging, e.g., from memory to panel video display devices. A matrix display apparatus for displaying video signals commonly comprises a display panel having an array of addressable components arranged in row and column lines of pixels. The two-dimensional row and column lines are usually arranged in a rectangular format. The addressable component is called a picture element, display element, or pixel, and consists of a light sensitive element. The display element may emit, reflect, or transmit light in response to signals addressed into the line. Display elements may be made from different materials and may be constructed in various ways depending on the type and use of the display device. Various types, such as liquid crystal cells, electrochromic cells, plasma cells, fluorescent display tubes, light-emitting diodes (LEDs), and electroluminescence cells have been known. Light modulating materials used to construct display elements have been well known in the industry, and they fundamentally depend on an applied electric field to modulate the amount of light emitted, reflected, or transmitted. Some of the light modulating materials do not exhibit sharp electric field versus light excitation characteristics. Thus, an active device such as a diode or transistor may be used in conjunction with the addressable components to improve the pixel light characteristics. For example, the use of a thin film MOS field effect transistor (TFT) as a switching element is well known to the artisans in the field.

The light output of the picture element may be proportional to the applied addressing signal in the matrix display. In order to address a specific picture element, or pixel, in a matrix display, the pixel must be identified and excited. The excited pixel will emit, reflect, or transmit light accordingly. The pixel in the latter case is being enabled. Within an array of a pixel matrix, each pixel may have a unique address that is specified in terms of row and column location, e.g., the element at row x, and column y, or element (x,y). To excite the pixel (x,y), so that to set it to the "on" status, the pixel (x,y) is enabled by addressing the location (x,y) and exciting the pixel. The pixel may be excited by supplying a voltage above a threshold level to the addressed location.

In one addressing technique, the pixel (x,y) is electrically coupled to a row conductor which intersects with a column conductor. The pixel (x, y) is enabled by addressing the specific row conductor line x and the column conductor line y. Each line is addressed by a driving means, which addresses the line according to an applied signal. The driving means consists of a column driver circuit for each column operable according to the line frequency of an applied video signal for supplying data signals derived therefrom to the column in which the pixel is electrically coupled, a row driver circuit for each row for scanning the row in which the pixel is electrically coupled to, and a control circuit which controls the timing of operation of the driver circuits, which is responsive to an applied video signal.

All pixels arranged in a row line are electrically coupled to a row line and thus to a row driver. Pixels arranged in a column line are electrically coupled to a column line and thus to a column driver. Therefore, M pixels in one row are commonly coupled to a row driver, and each separately coupled to one of M column drivers. Similarly, N pixels in one column are commonly coupled to a column driver, and each separately coupled to one of N row drivers. A matrix display of M×N pixels usually requires M column drivers and N row drivers, or M+N line drivers. Thus, a display with a resolution of 128×1024 pixels consists of 1,310,720 pixels, 1280 columns of pixels and 1024 rows of pixels, and 2304 line drivers. Images are formed by enabling, or disabling, selected pixels in the pixel array usually in sequential manner from left to right and top to bottom.

FIG. 1 depicts a conventional video matrix display device 100 comprising a plurality of pixels P that are arranged along the y-axis in N rows driven by drivers $R_N$ and along the x-axis in M columns driven by drivers $C_M$. Each pixel P has two connecting ports. The first port 122 of the pixel $P_{1,1}$ is coupled to the row line 110*a* and the second port 112 of the pixel is coupled to the column line 120*a*. The first port of pixels $P_{1,1}$ to $P_{1,M}$ are electrically coupled to row 110*a*, while the second ports are separately coupled to the corresponding columns driven by $C_1$ to $C_M$. For example, to enable pixel $P_{3,4}$ row line 110*c* is addressed through driver $R_3$, and column line 120*d* is simultaneously addressed through driver $C_4$. A specific pattern of pixels may be addressed for enabling the pixels by activating a plurality of row and column drivers in a sequential manner. Thus, a large number of drivers are physically needed to construct a matrix display. The number of drivers increases with the increase in the display resolution since larger numbers of rows and columns are needed. A need therefore exists to reduce the number of drivers in a device using addressable components. For high-resolution displays, the cost of a large number of drivers may be significant to the overall cost of the display. The complexity of circuitry components associated with the drivers, such as signal generators, control units, and driver memory also increases with resolution, and further provides a disadvantage in addition to the large number of drivers. Reducing the number of needed drivers in matrix display devices, such as flat panel displays, while achieving or maintaining the same or better image resolution is desirable.

SUMMARY OF THE INVENTION

The problems identified above may be in large part solved by a matrix display method and apparatus that eliminates the large number of row and column line drivers needed to address and selectively enable addressable elements or pixels. To achieve the above advantage, an embodiment of the apparatus may provide a total of only two drivers to drive a M×N display device, such as a flat panel display. A first and a second driver may be used to drive first and second signals at slightly different frequencies (or phase) on a first and a second display conductor. A plurality of pixels may be coupled between the first and second display conductors. The pixels may be addressed according to a pixel location in which the first signal may be approximately in phase with the second signal. The pixel location changes from one pixel to the next at a scan rate proportional to the difference between the first and second signal frequencies. The first and second conductors may contain a plurality of delay elements and tap-off points, wherein each pixel may be coupled between tap-off points on the first and second conductors. A plurality of pixel row and column conductors may be provided, each connected to a different tap-off point of the first and second display conductors.

The row and column conductors may be terminated by their characteristic impedance to prevent any reflection of the traveling signal. Further, the first and the second display conductors may also be terminated by their characteristic impedance to prevent any reflection of the signals traveling on any of the conductors. The periods of the first and second signals may be greater than or approximately equal to a propagation delay of between first and last tap-off points on the first and second conductors, respectively. The pulse width of the first and second signals may be less than or approximately equal to a propagation time of the first and second signal between adjacent tap-off points on the first and second display conductors, respectively. The matrix display pixels may be selectively enabled by modulating an amplitude of the first signal and an amplitude of the second signal when the selected pixel location(s) is addressed so that the voltage differential between the first and second signals is sufficient to enable the addressed pixel.

Broadly speaking, a method and apparatus are contemplated to selectively enable addressable elements in a M×N array arrangement. The apparatus may comprise two separate display conductors driven by two separate drivers where the frequency of their signals is different. A plurality of addressable elements may be connected to tap-off points on the two display conductors. A plurality of row and column conductors may be connected to the first and second display conductors. Each row or column conductor may be connected into a single point on the display conductor and may be terminated by its characteristic impedance. The signals traveling on each display conductor may be sequentially delayed by delay elements. The pixels may be sequentially addressed at a rate proportional to the difference in frequency between the first and second signals, and may be selectively enabled according to the difference in amplitude between the first and second signals.

A pixel display is further contemplated comprising a sequence of pixels, each pixel coupled between a first display conductor and a separate second display conductor wherein a first driver and a second drivers drive a first signal and a second signal on the first and second display conductors, respectively. The pixels may be sequentially addressed at a rate proportional to the difference in frequency between the first and second signals, while they may be selectively activated according to the difference in amplitude between the first and second signals.

A method is further contemplated for driving an addressable elements array comprising driving a first signal on a first addressing conductor at a first frequency, and driving a second signal on a second addressing conductor at a second frequency. The second addressing conductor is separate from the first addressing conductor, and the first and second frequencies may be slightly different. The addressable elements may be sequentially addressed according to an addressable element location where the first signal is approximately in phase with the second signal. The activation of select addressable elements may be achieved by modulating the amplitudes of the first and second signals during the time when a pixel selected to be turned on is addressed so that the amplitude differential of the first and second signals may be sufficient to activate the selected addressable element.

For another solution, in a display comprising pixels arrayed in M rows and N columns, pixels in every row are coupled together by a row conductive element having first and second ends, and pixels in every column are coupled together by a column conductive element having first and second ends. The row-coupled pixels are driven by first and second row drivers ($DX_1$, $DX_2$) coupled respectively to the first and second ends of the row conductive element. The column-coupled pixels are driven by first and second column drivers ($DY_3$, $DY_4$) coupled respectively to the first and second ends of the column conductive element. Thus, a total of only four drivers is used to address M×N elements in the array.

Each driver outputs a time-varying signal of a different frequency, and the driver signals propagate through the associated conductive element. The amplitude of any one driver is about half the total amplitude needed to activate or turn on a pixel. The time-varying voltage seen by a pixel in a row is determined by the amplitude and frequency ($\omega_1$, $\omega_2$) of row drivers $DX_1$, $DX_2$, and by the propagation time needed for the signals to reach the pixel. Similarly, column pixels see time-varying voltage signals determined by the amplitude and frequency ($\omega_3$, $\omega_4$) of column drivers $DY_3$, $DY_4$, and by the relevant propagation time.

One embodiment implements a pixel enabling signal using the beat-frequency difference between two driver source signals that propagate through a pixel string from opposite ends of the string. The driver difference signal dwells sufficiently long on each pixel location to deliver sufficient energy to turn the pixel on or off. Vertical scan rate is determined by frequency differential ($\omega_1-\omega_2$), and horizontal scan rate frequency differential ($\omega_3-\omega_4$). The absolute frequencies $\omega_1,\omega_2,\omega_3,\omega_4$ are set proportional to the propagation delay of the medium through which the signals from $DX_1$, $DX_2$, $DY_3$, $DY_4$ travel. Preferably the frequencies of the driver signals coupled to the same conductive element are approximately comparable to the inverse of the end-end propagation time associated with the conductive element. Video information to be displayed is used to modulate at least one of the row drivers and one of the column drivers.

In another embodiment, the columns may be addressed in parallel. Columns may be coupled to a display conductor by a charge transfer/isolation circuit. A voltage waveform or pulse train may be propagated down the display conductor such that a pulse is present on the display conductor for each pixel of a row of pixels to be addressed. When the beginning of the pulse train has propagated to the last column tap-off point so that a different pulse is present at each column tap-off point corresponding to the row of pixels to be selected, a corresponding charge is transferred to each column conductor in parallel. Thus, a voltage is supplied to turn each pixel on or off on the selected row as determined by the state of the pulse train at each column tap-off point. During the time the voltages are supplied to the column conductors, the column conductors are isolated from the column tap-off points so that a next pulse train corresponding to the next pixel row may be propagated down the display conductor. The rows may be selected by any row addressing technique, such as individual row drivers, or a beat-frequency technique employing only two row drivers.

In one embodiment, the charge transfer/isolation device for each column conductor comprises a diode with its anode connected to a column tap-off on the display conductor and its cathode connected to the column conductor. A capacitor may also be included. The anode of each capacitor may be connected to the column conductor and the cathodes connected to a load signal. The load signal may be driven to a low voltage to transfer charge to the capacitors according to the state of the pulse train at each tap-off point. The load signal may be driven to a high voltage to supply the charge to the column conductors. When the load signal is high, the diodes may be reversed biased or off to that the column conductors are isolated from the display conductor a the next row pulse train is propagated on the display conductor.

Other features and advantages of the invention will appear from the following description in which the preferred embodiments have been set forth in detail, in conjunction with the accompanying drawings.

BRIEF DESCRIPTION OF THE DRAWINGS

Other features and advantages of the invention will appear from the following description in which the preferred embodiments have been set forth details, in conjunction with the accompanying drawings, in which.

Figure 1:
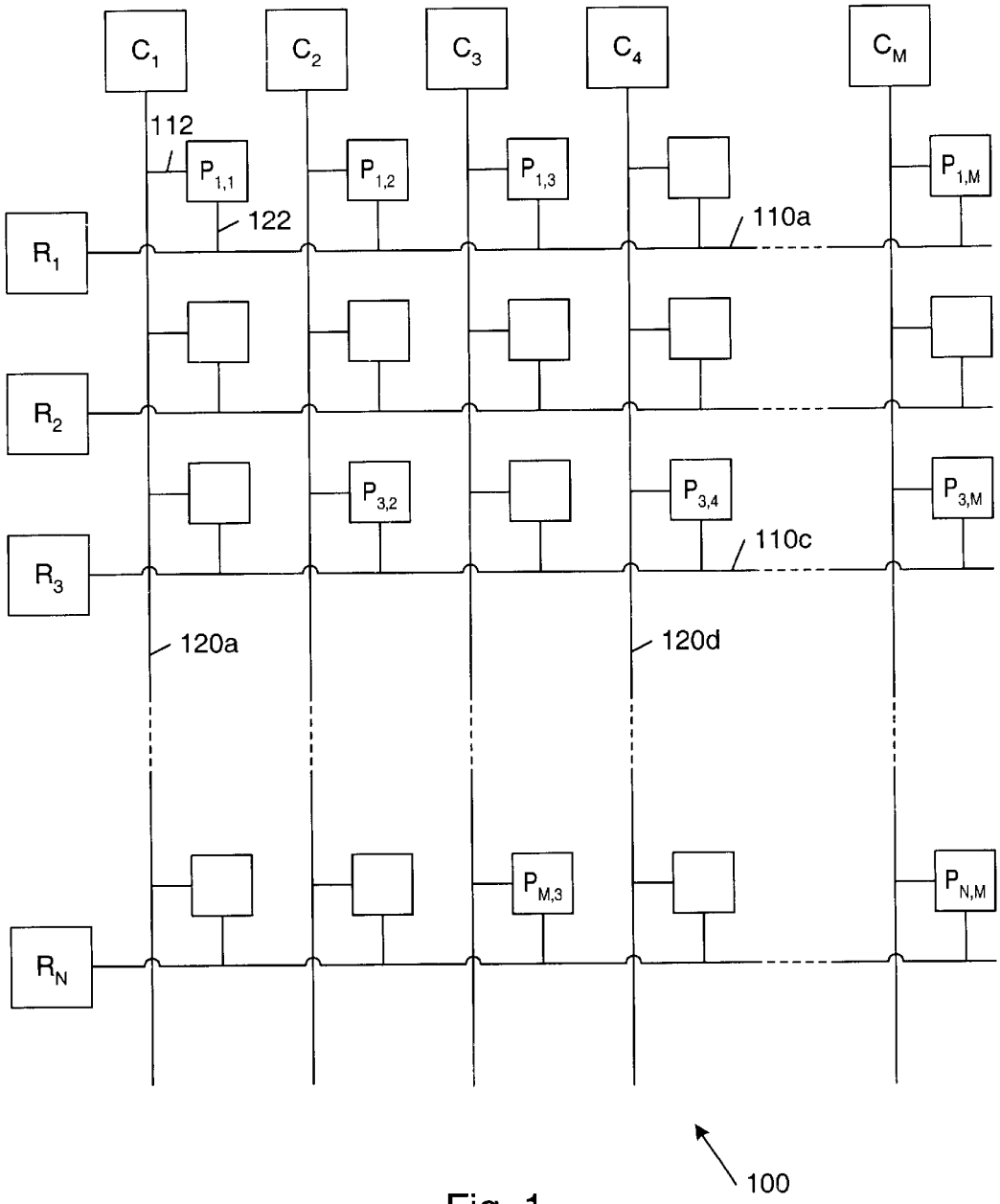
Fig. 1 (Prior Art)
FIG. 1 is a block diagram illustrating a matrix display device comprising M×N pixels, driven by a total of M+N drivers, according to the prior art.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Figure 2:
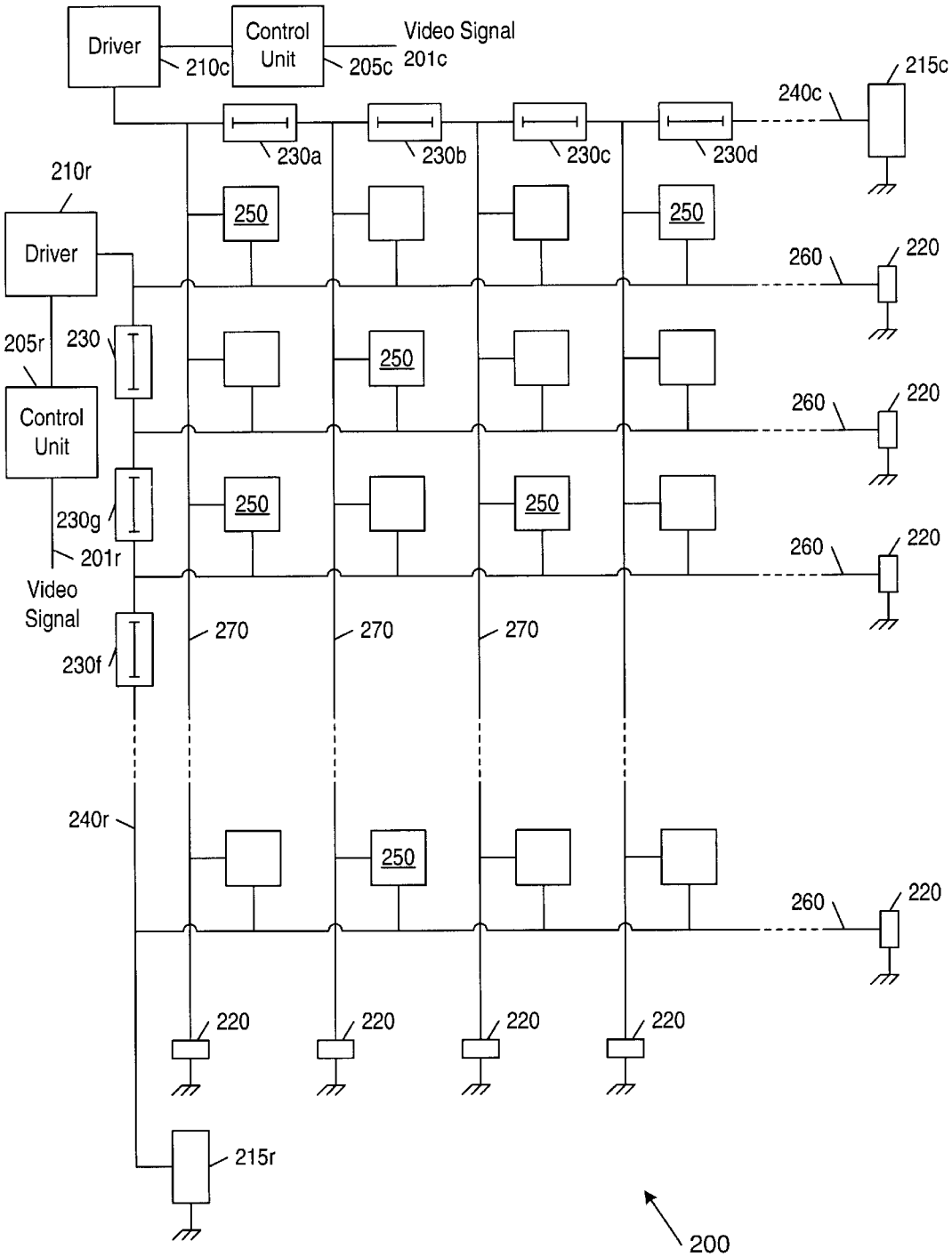
FIG. 2 is a block diagram illustrating an embodiment of a matrix display device comprising M×N pixels driven by two drivers.

Turning now to the drawings, FIG. 2 is a block diagram depicting an embodiment of a matrix display device 200 comprising M×N addressable elements, or pixels, 250 driven by two drivers 210*r*, 210*c*. Each driver 210 generates a signal regulated by the control unit 205. The driver 210 signal is fed into display conductors 240 terminated by characteristic impedance 215 to prevent the signal from being reflected. Note that elements associated with column driver 210*c* may be designated with a "c" suffix, such as column display conductor 240*c*, and elements associated with row driver 210*r* may be designated with an "r" suffix, such as row display conductor 240*r*. However, these elements may be generically referred to without the suffix. Display conductor 240 may be any signal conduction medium that permits propagation of the signal from the driver 210 to the impedance termination unit 215. The signal generated by driver 210 propagates through display conductor 240 at a speed proportional to the speed of light ($3\times10^8$ meter/sec), and inversely proportional to the square root of the dielectric constant of the conductor material. The signals generated by drivers 210 are different in frequency or in phase. Display conductor 240 may comprise delay elements 230, which delay the signal propagation between two adjacent columns or rows. The plurality of pixels 250 in the matrix display device 200 is shown arranged in a rectangular format comprising N electrically conductive lines 270 (columns) and M electrically conductive lines 260 (rows). It will be appreciated by those skilled in the art that arrangements of the plurality of pixels 250 are not restricted to only rectangular format but they can be made into different shapes and patterns. Columns 270 and rows 260 are electrically coupled separately to lines 240 so that the signals traveling in respective display conductors 240*c,r* may be propagated through the conductive columns and rows. Each of the plurality of columns 270 and each of the plurality of rows 260 may be terminated by an impedance element 220. Impedance element 220 is selected so that no reflection is allowed for the signal traveling down that line. Each of the plurality of pixels 250 is coupled to a conductive column 270 and a conductive row 260.

An individual pixel of plurality of pixels 250 is enabled, or disabled, based on the conditions of the signals being conducted through at least one column 270 and one row 260. The conditions comprise the frequency difference between the signals of the drivers 210 and amplitude of at least one driver 210 signal. The frequency difference is determined based on driver 210 signal frequencies, the delay characteristics of the display conductor, and the type of the addressable elements. The amplitude of one or both signal drivers is determined based on modulating video signals. Only two drivers may be needed to address M×N pixels compared to M+N drivers needed to address the same number of elements in the prior art.

Figure 3:
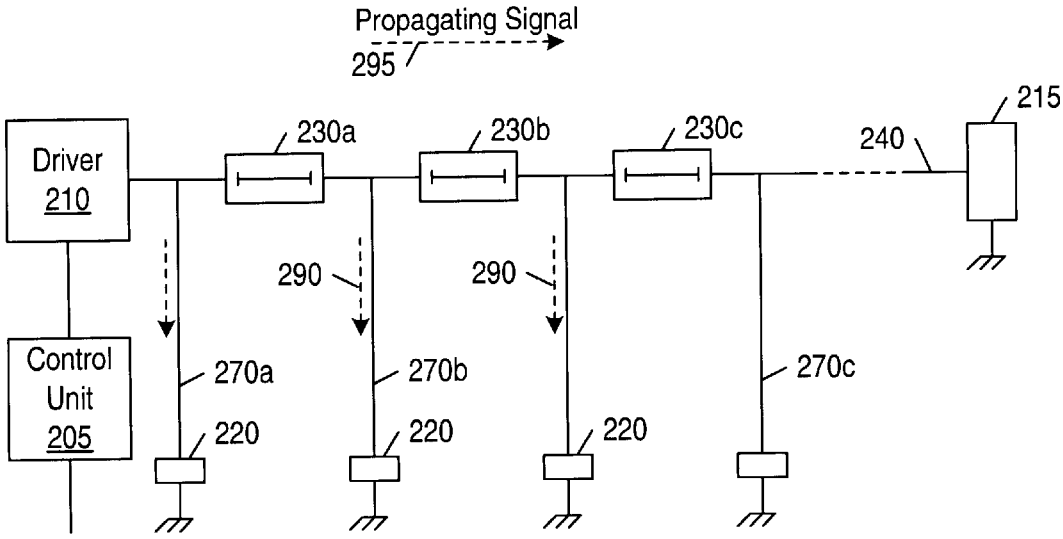
FIG. 3 depicts the propagation of signals within a matrix display.
Figure 4:
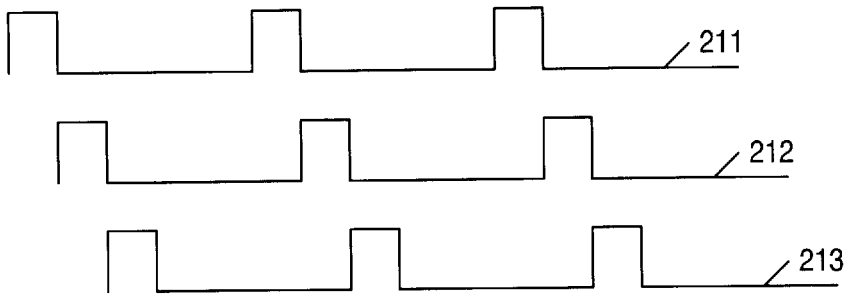
FIG. 4 illustrates signal waveforms associated with FIG. 3, in sequential manner at a point of time.

Turning now to FIGS. 3 and 4, the propagation of signals according to the embodiment of FIG. 2 is illustrated. FIG. 3 depicts a portion the matrix display device 200 showing control unit 205, signal driver 210, display conductor 240, delay elements 230, and impedance units 215 and 220. The direction of signal propagation down the line 240 is shown by the numeric 295. The directions of the signal propagation down the conductive columns 270 are shown by the numeric 290. FIG. 4 shows the waveform of a driving signal generated by signal driver 210 and transmitted through line 240. The specific wave shape is arbitrary, and the driver signal is shown as numeric 211. Signal 211 is fed into the delay element 230*a* before reaching column 270*b*. The signal 211 is the same at the first column 270*a* moving in the direction 290. The signal 212 is generated in column 270*b* due to the delay by 230*a*. Further, the signal 213 is generated in column 270*c* due to the delay by delay element 230*b*. Similarly, the signal propagated through line 240 is sequentially delayed m-1 times before reaching the last conductive column 270*m*.

Figure 5:
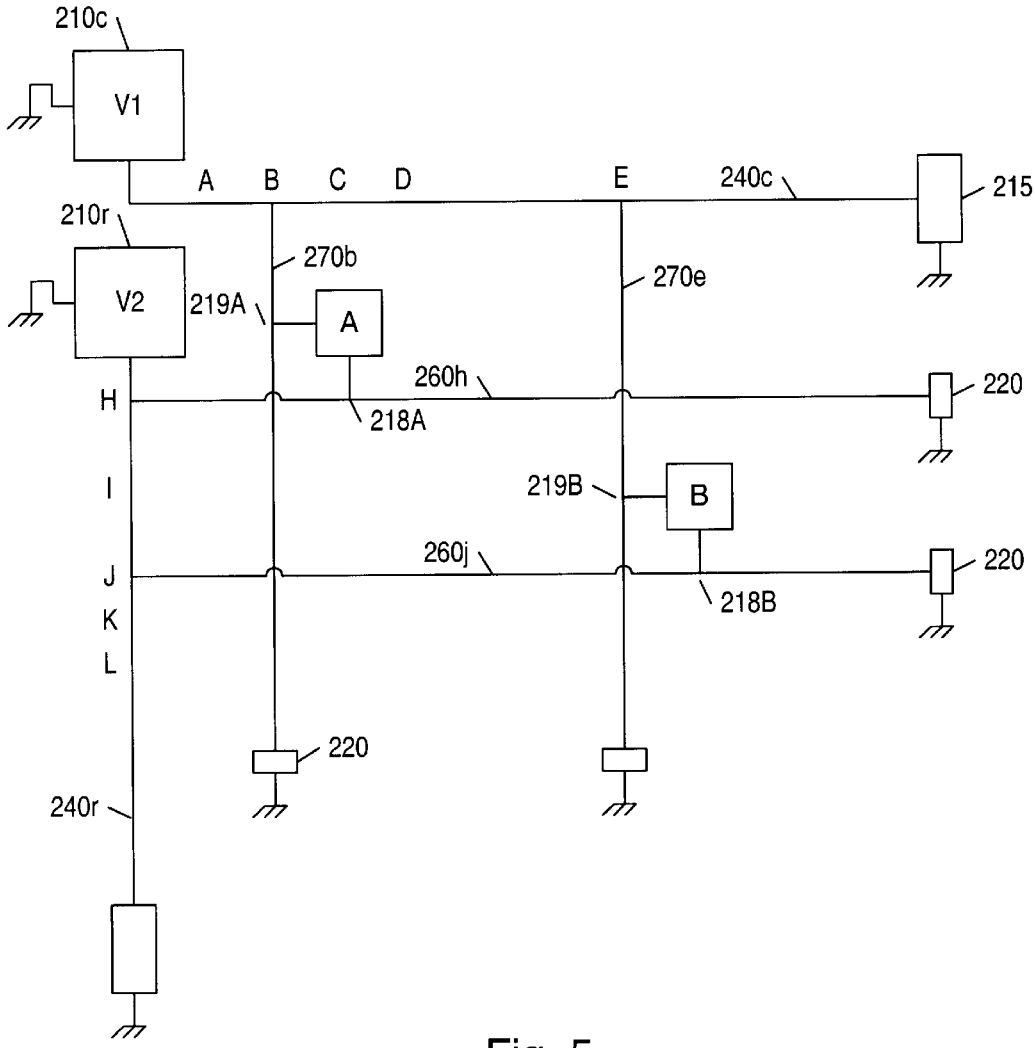
FIG. 5 is a simplified diagram to illustrate how individual elements are addressed in a matrix display device.

Turning now to FIG. 5, an illustration of the principle of operation according to one embodiment is shown. Drivers 210*c* and 210*r* separately drive two display conductors 240*c* and 240*r*, respectively. Conductive lines forming columns 270 and rows 260 are used to drive the coupled pixels A and B. Columns are electrically coupled to line 240*c* at the locations (A–E), while the rows are electrically coupled to line 240*r* at the locations (H–L). For simplicity, only two columns and two rows are shown. Pixels A and B are electrically coupled to columns 270*b* and 270*e*, as shown at 219A and 219B, and electrically coupled to rows 260*h* and 260*j*, as shown at 218A and 218B. V1 and V2 represent the signals from drivers 210*c* and 210*r*, respectively, whose differential amplitude may be sufficient to enable or disable a pixel. The pulse width of the signals generated by 210*c* and 210*r* is selected to be the propagation time between two adjacent nodes (such as A and B) on the conductor line. The period of the voltage signals may be comparable to or greater than the propagation time each signal takes to travel down the lines 240. Therefore, at any point in time each location (A–E) across line 240*c* will have a different phase of the driving signal. Similarly, each location (H–L) across line 240*r* will have different phase of the driving signal. At some locations the differential voltage amplitude may be higher than a threshold level needed to enable a pixel, and at other locations may be lower than the threshold level.

Since the periods of the voltage signals V1 and V2 may be set comparable to (or greater than) the signal propagation time the signals take to travel down the lines 240, the frequency of V1 and V2 may be proportional to the propagation delay of the lines 240. Since V1 and V2 have different frequencies, the amplitude of the differential voltage signal (the sum of V1 and V2) at any particular pixel location is the waveform where the shape of the high frequency carrier signal is the low frequency difference between the two signals. The rate of change of the differential voltage signal can be independently controlled by selecting the frequency difference between V1 and V2 signals. According to one embodiment, this control is provided by the control unit(s) 205 in FIG. 2 of this invention. The provided control function(s) is responsive to the video signal(s) 201 shown in FIG. 2. Since the amplitude of the differential voltage signal is the pixel addressing signal, which varies in both time and location, enabling or disabling of a specific pixel or a plurality of pixels may be achieved. Further, since the frequency of the modulated signal is much lower than the absolute frequency of V1 and V2 signals, addressing of pixels can be performed at a reasonably slow rate.

Considering now pixel A in FIG. 5. At a point of time when the signal V1 traveling line 240*c* at the location B has a specific amplitude that is considered "high" one port (or side) of pixel A will be set "high" through the coupling at 219A. To enable pixel A, the second signal V2 traveling down line 240*r* may be low at the row H at approximately the same point in time when the V1 signal is high at the column B, so that the other side of pixel A is set low through the coupling at 218A. If the amplitude of the differential voltage signal across pixel A has been modulated above the threshold level, pixel A will be enabled (turned on). Otherwise, pixel A is disabled (scanned, but turned-off).

Figure 6:
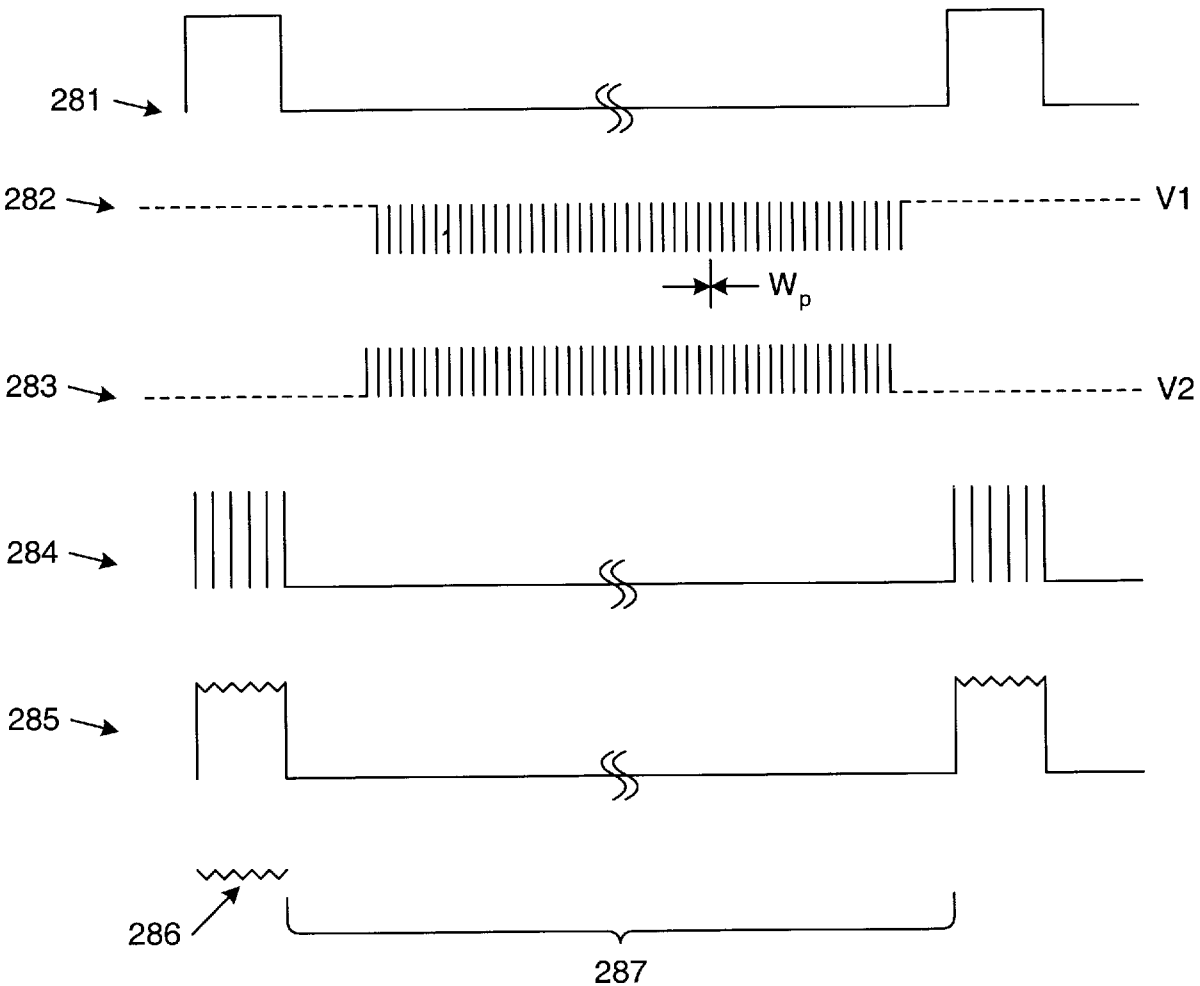
FIG. 6 illustrates display signal waveforms at various points of the display of FIG. 5.

FIG. 6 illustrates an example of the signals at various points of FIG. 5. The signal numeric 281 donates the desired voltage signal across the pixel A in order to enable pixel A. The desired voltage signal is applied across the nodes 219A and 218A. The numerics 282 and 283 refer to the driver signals V1 and V2, respectively. At the location shown, the signal 282 is the signal at node 219A and 283 is at node 218A. The numeric 284 shows the differential voltage signal (V2−V1) across pixel A. The actual signal across the pixel may be more of the shape of the signal 285 due to capacitance of the pixel. V1 may comprise periodic low-going pulses while V2 may comprise periodic high-going pulses. The pulse width is shown as $W_P$. During the point in time in which V1 and V2 are approximately in phase at the location of pixel A, the pulses of V1 will sum with the pulses of V2 to create the addressing/enabling differential voltage shown at time interval 286. If the amplitude of the signal pulses is modulated sufficiently high (low) during time interval 286, pixel A will be enabled (turned on). When V1 and V2 are not in phase at pixel A, as shown at time interval 287, pixel A is not addressed. The other pixel locations of the display are sequentially addressed during 287.

The pixel-addressing scheme above is given as a matter of example. Addressing of a pixel in accordance with this invention is not restricted to the example above. It will appreciated by those skilled in the art that the enabling, or disabling, of pixels can be achieved by various combination of the signal across nodes 218 and 219 that are appropriate to the particular addressable element. Possible combinations, in addition to the above example, include different signal shapes, orientation, duration, frequency, levels, and logic.

Figure 7:
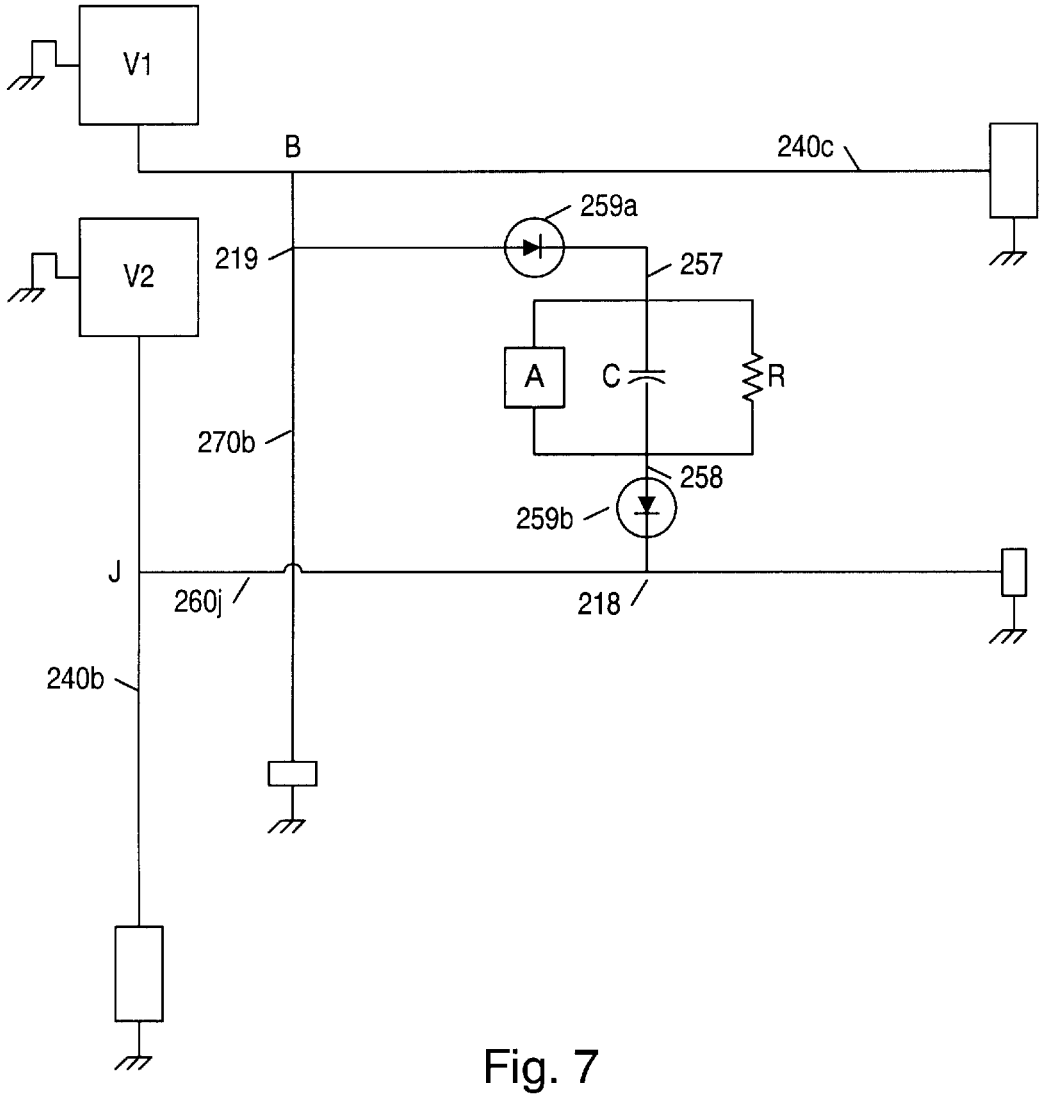
FIG. 7 illustrates the enabling of an addressable element that requires different enabling needs than those directly provided by the addressing signals.

As mentioned earlier, the signal generated by the driver 210 propagates in line 240 at a speed proportional to the speed of light and inversely proportional to the square root of the medium dielectric constant. The value of the dielectric constant is typically ranged between 1–10 for the majority of materials used in the field of electronics. Therefore, the driver signal travels the conductor line at a speed in the order of a few $10^8$ meters per second. For typical dimensions in a matrix display device such as video monitors, the distance between pixels is in the order of one millimeter or less ($10^{-3}$ meters), and the length of the display is in the order of tens of centimeters ($10^{-2}$ meters). The residence time the signal may spend on each coupling nodes on line 240, such as A–E and H–L of FIG. 5, can be assessed by:

$$Tr=(D)^{0.5}\times L/3\times 10^8\times N \text{ (seconds)}$$

where D is the conductor medium dielectric constant, L is the length of the conductor in meters, and N is the number of coupling nodes on the conductor. For a conductor line of 12 inches, and 1280 coupling nodes, the signal residence time on each node is in the order of few picoseconds. Depending on the practical addressable element technology, the residence time of enabling signals may be significantly greater than few picoseconds. In a typical addressable element, the residence time requirements of the enabling signal may be in the order of tens of nanoseconds. The total energy delivered to the addressable element may not be sufficient to enable the pixel if the applied pulse is very short. In such cases, a storage element is required to accumulate enough energy for sustaining the display element. Further, depending on the particular type of the display element, the signal across the element, or at the contact mode(s) may also need to be rectified or reshaped for the purpose of enabling the element. FIG. 7 shows an example which implements a storage element to enable a pixel when the addressing pulse width is much shorter than the element enabling need. The figure shows two diodes 259 coupled to address lines 270*b* and 260*j*, and a resistor and capacitor coupled across pixel A. When the signal at node 219 is high and the signal at node 218 is low, diodes 259 are conducting. The voltage at node 257 is the voltage of the line 240*c* less the voltage drop on diode 259*a*. The voltage at node 258 is the voltage of the line 240*r* plus the voltage drop across diode 259*b*. The voltage difference between nodes 257 and 258 is the addressing or enabling voltage pulse across the pixel A. This pulse occurs at a frequency proportional to the difference between drivers 210*c* and 210*r* signal frequencies, and applied across pixel A depending on the alignment of the high and low of the signals V1 and V2 at points B and G, respectively. The capacitor C coupled across the pixel A is selected to hold charge that is sufficient to sustain pixel A in the enabling state until the next enabling pulse, but not sufficient to enable pixel A by itself. Thus, the capacitor charge is discharged into resistor R if the next enabling pulse is not applied and consequently pixel A is disabled. The above example is intended only for the purpose of explanation and not to limit the invention to the specific application explained. It will be appreciated by those skilled in the art that numerous circuit combinations are possible to relate the addressing signal conditions into the specific enabling/disabling needs of the particular display element.

Figure 8:
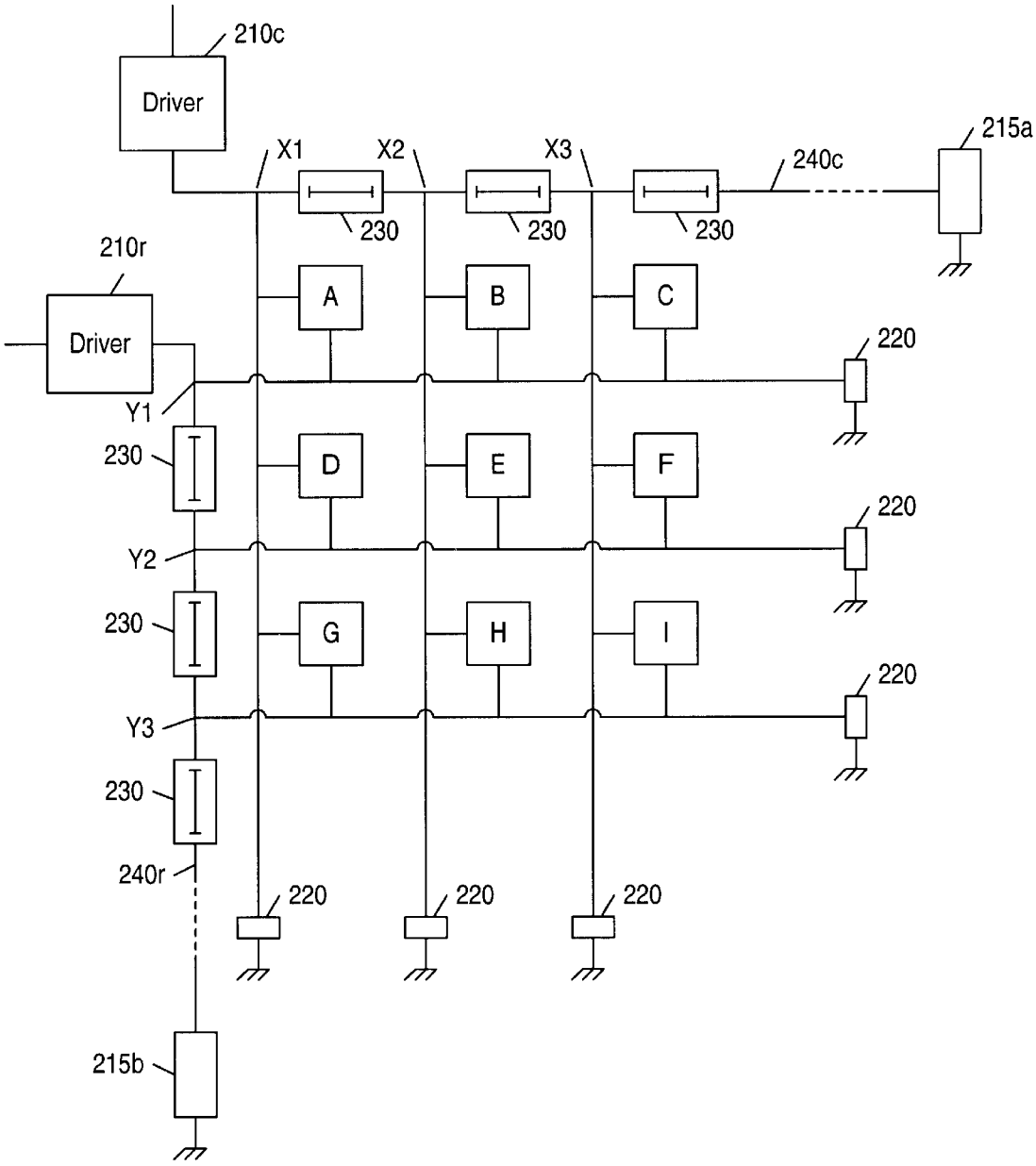
FIG. 8 depicts a plurality of pixels in a simplified matrix display device to illustrate the scanning of pixels.
Figure 9:
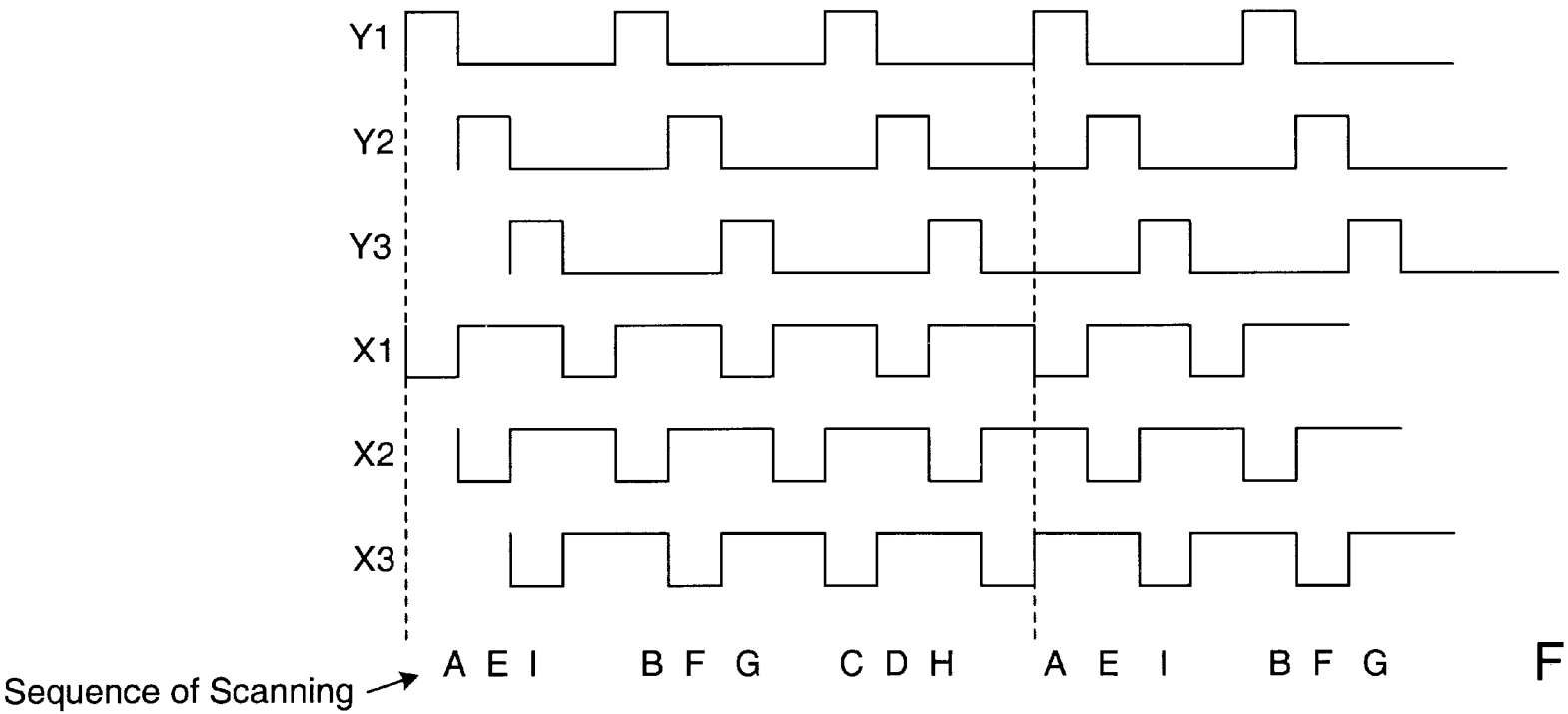
FIG. 9 illustrates the wave fronts of signals in FIG. 7 illustrating the scanning (e.g., sequential addressing) of a plurality of pixels.
Figure 10:
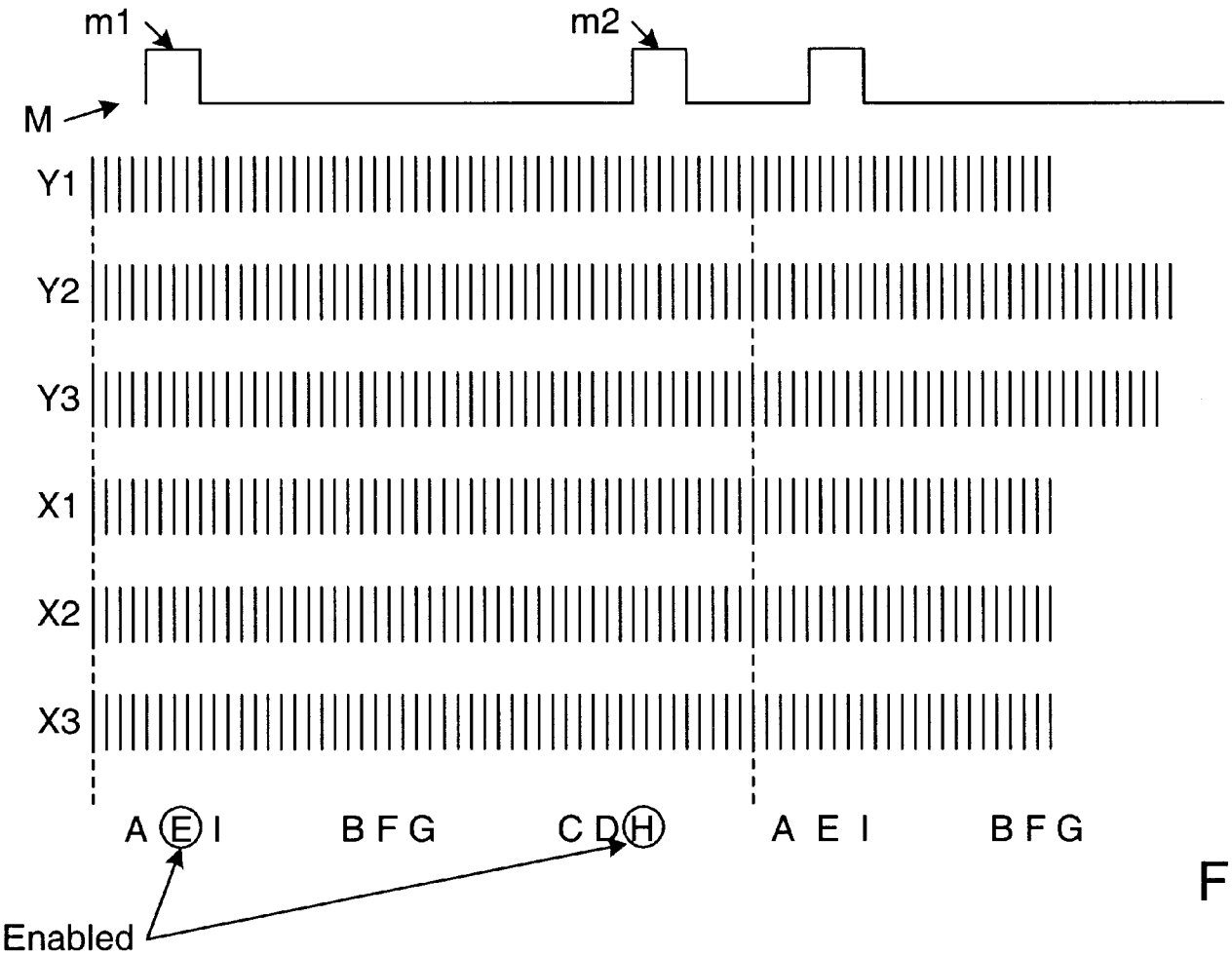
FIG. 10 illustrates the waveforms of driver signals and a modulating signal to enable a particular pixel in FIG. 7.

Turning now to FIGS. 8, 9 and 10, as an illustrative example, the scanning of a plurality of addressable elements (pixels) according to one embodiment of the present invention is shown. One port of each of a plurality of pixels (A, B, and C) are commonly coupled to row line y1 while the other ports are coupled into column lines x1, x2, and x3, respectively. Similarly, pixels (D, E, F) and (G, H, I) are coupled into the corresponding row and address lines. The signal at y1, y2, and y3 is the time-dependent voltage of line 240*r*, generated by driver 210*r*, consequently delayed by delay elements 230. Similarly, the signal at x1, x2, and x3 is the time-dependent voltage of line 240*c*, generated by driver 210*c*, consequently delayed by delay elements 230. FIG. 9 shows an example of the signal waveform on line y1, y2, y3; and x1, x2, and x3. In this example, for simplicity of illustration, the driver 210*r* (FIG. 8) signal is selected as 180-degrees in phase compared to the driver 210*c* signal. Only nine pixels are shown for simplicity. Further, in this example, the enabling scheme is selected to occur if the voltage at the row addressing line is high and the voltage at the column addressing line is low. Consequently, if the voltage across the pixel is maximum (the difference between the two addressing signals), the pixel will be enabled. Otherwise the pixel will be disabled. As can be seen in FIG. 8, pixel A achieves simultaneous high and low signals, followed by pixel E, followed by pixel I, and so on. Since the addressing signals on lines 240 are delayed by a fixed amount by delay elements 230 between the row lines and the column lines; and the enabling pulse width is set equal to approximately the delay amount between two adjacent rows or columns to prevent more than one pixel being enabled at a time; a diagonal scanning results throughout the pixels. In this example, pixels A–I are diagonally scanned in the following sequence: A, E, I, B, F, G, C, D, H.

To enable (turn-on) a particular pixel or a plurality of pixels, the amplitude of the differential signal across the pixel is modulated by the incoming video signal. FIG. 10 shows the signals at row y1, y2, and y3; and column x1, x2, and x3, along with a modulating signal M. Note that pulse train signals are shown wherein multiple pulses will sum across a given pixel to address/enable the pixel, as opposed to the single pulse example of FIG. 9. The position of the letters A, E, I, B, F, etc, indicate the time during which the pulse train signals on row y1, y2, y3 and column x1, x2, x3 are in phase at the corresponding pixel location. To enable pixel E and H, for example, the amplitude of at least one driver signal is modulated. The modulation occurs at the time when the scanning effect reaches the particular pixels to be enabled, i. e., when the signals are approximately in phase at that pixel location. FIG. 10 shows the time-dependent modulating signal M with two pulses m1 and m2, where the time delay between m1 and m2 correspond to the scanning delay between pixel E and pixel H. The pulse m1 occurs at the time when the pixel scanning is addressing pixel E, thus pixel E is enabled. Similarly, the pulse m2 occurs at the time when the pixel scanning is addressing pixel H, thus pixel H is enabled. If the drivers' signal frequencies are much higher than the enabling need of the particular display element, many driver pulses may coincide across the pixel before the addressing location moves into the next pixel. Thus, allowing for the simple video modulation described above. The time between the two vertical dashed lines is the time required for one complete scan of the nine pixel display. In the first scan illustrated in FIG. 10, only pixels E and H are enabled (turned on). It is clear how this nine pixel example may be expanded to any desired display size or resolution.

Figure 11:
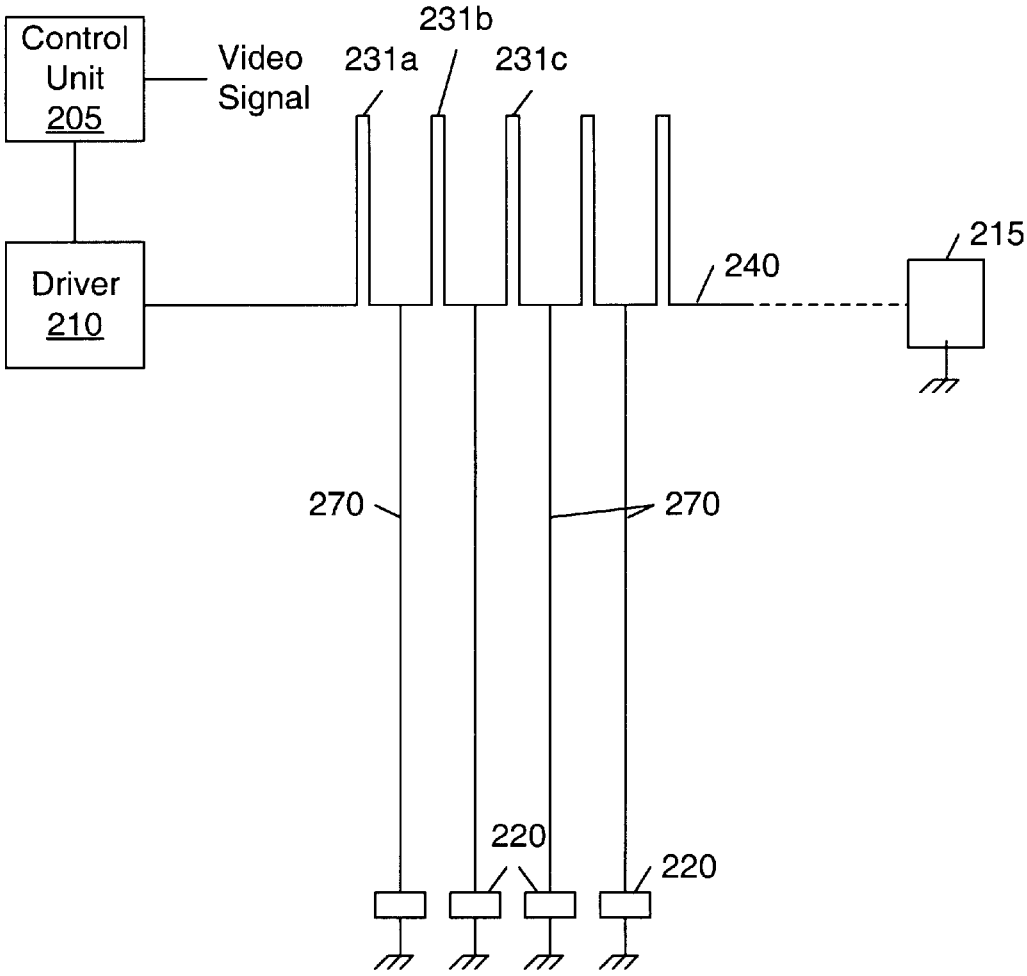
FIG. 11 depicts an embodiment in which the delay elements of FIG. 3 are extensions made on a circuit board.
Figure 12:
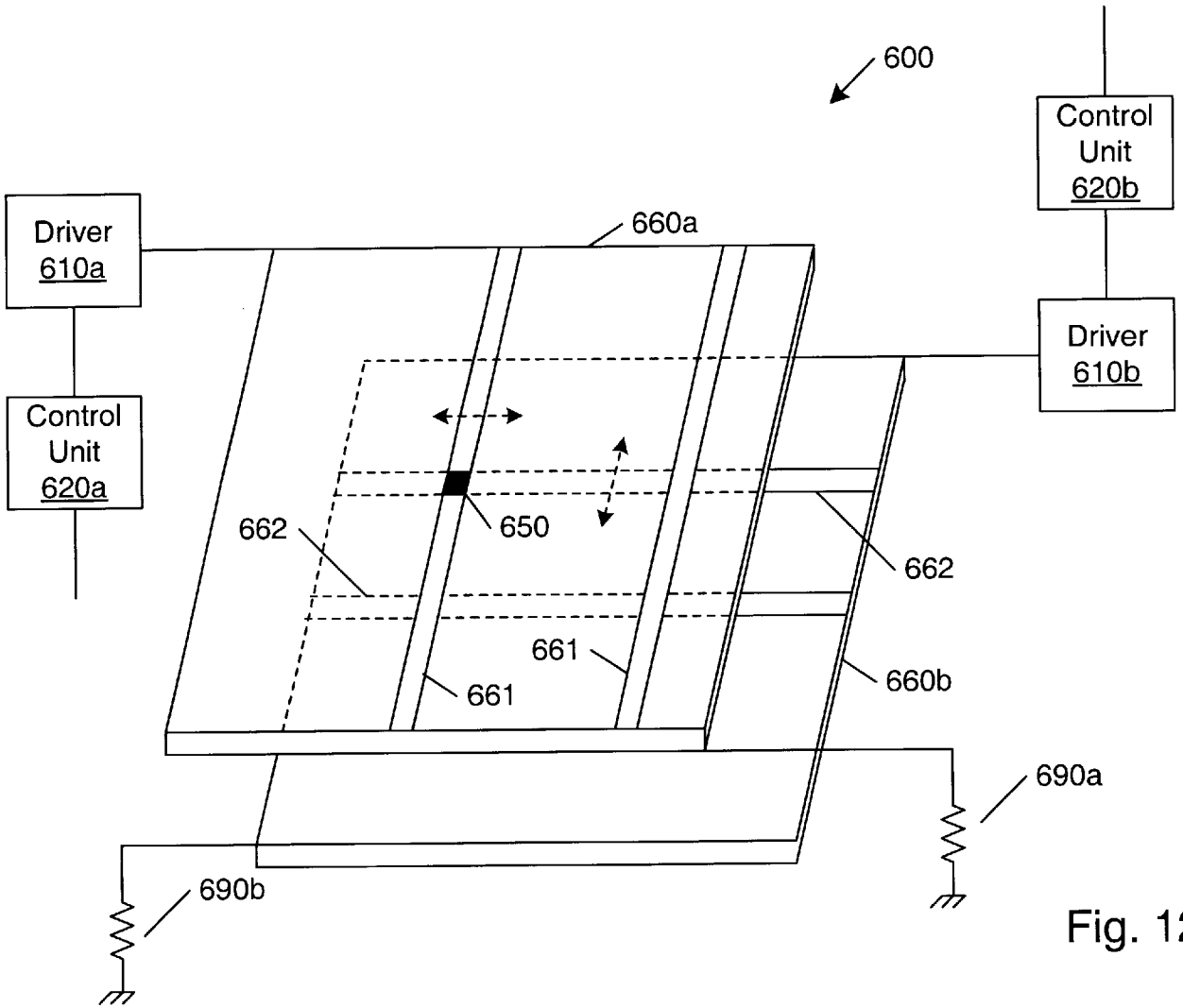
FIG. 12 depicts an embodiment in which the display conductor is a plane.

The elements of the display device according to the preset invention are not restricted to the specific examples given in the figures. For example, the delay elements, display conductors, address lines, as well as the addressable elements may be implemented using different techniques known in the art. By a means of example, FIG. 11 depicts an embodiment in which the delay elements are made as extensions of the first and second conductors. For example, a delay element may comprise a serpentine printed circuit board trace. Numeric 231 represent delay elements as taps made of the conductor line 240. The addressing lines 270 are coupled to line 240 between the delay elements. FIG. 12 depicts a display 600 comprising a first plane 660*a* and a second plane 660*b* acting as a first and second displays conductors. Plane 660*a* is coupled into driver 610*a*, which drives the addressing signal through 660*a*. Plane 660*b* is coupled into driver 610*b*, which drives the addressing signal through 660*b*. Drivers 610 are coupled to control units 620 which control the addressing signals in accordance with the video signals to be displayed. Conducting planes 660 are coupled to units 690 to prevent any wave reflection that may occur in the conducting planes. In this embodiment, portions of the plane conductor 610*a* act as column addressing bands 661, while portions of the plane conductor 660*b* act as row addressing bands 662. An addressable element or pixel 650 is created in the area where enabled bands of the two conducting planes overlap. A particular pixel or a plurality of pixels is addressed when the signals through the addressing bands 661 and 662 meet designated requirements needed to enable the addressable element.

Figure 13:
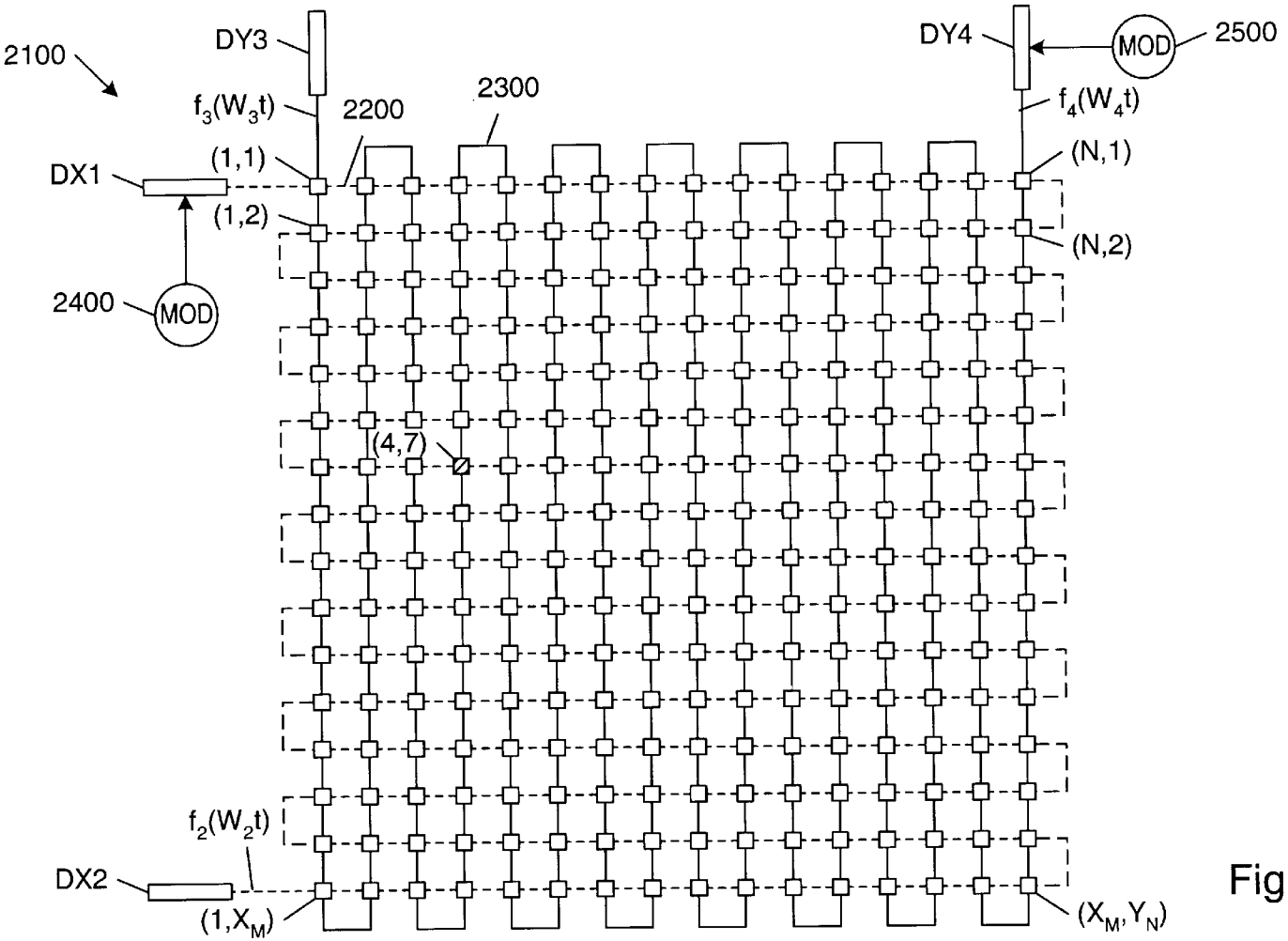
FIG. 13 is a block driver of a display comprising M×N pixels, driven by a total of four drivers.

Turning now to a different embodiment, FIG. 13 depicts an array 2100 as comprising a plurality of pixels (again shown as squares) that are arranged along a y-axis in M rows and along an x-axis in N columns. Similar to FIG. 1, the M×N pixels are identifiable by their co-ordinates, e.g., pixel (1,1), pixel (2,1) through pixel $(X_M,Y_N)$. However, in array 2100, each horizontal pixel is coupled together by a common row conductive element 2200, and each vertical pixel is coupled together by a common column conductive element 2300. By "coupled together" it is meant that electromagnetic energy carried by the conductive element is coupled to the pixels. Such coupling may be ohmic, e.g., a direct electrical connection between the conductive element and pixels, or non-ohmic in that it suffices that the energy transfer occurs, perhaps by electrostatic coupling or otherwise.

In FIG. 13 row conductive element 2200 is drawn in phantom to make it more readily distinguished from column conductive element 2300. In the embodiment shown, conductive elements 2200 and 2300 are each serpentine-like in shape and will have a known end-to-end length determined by the physical dimensions of array 2100. The physical dimensions of array 2100, in turn, are affected by the individual pixel size and the spaced-apart distance between pixels.

The row-coupled pixels are driven by first and second rowdrivers ($DX_1$, $DX_2$) coupled respectively to the first and second ends of the row conductive element 2200. Similarly, column-coupled pixels are driven by first and second column drivers ($DY_3$, $DY_4$) coupled respectively to the first and second ends of the column conductive element 2300. As explained herein, a total of only four drivers ($DX_1$, $DX_2$, $DY_3$, $DY_4$) is used to address the M×N elements in the array.

Each driver outputs a time-varying signal of a different frequency, and the driver signals propagate through the associated conductive element. Thus, driver DX1 outputs a driver signal f1($\omega_1$t), driver DX2 outputs f2($\omega_2$t), driver DY3 outputs f3($\omega_3$t), and driver DY4 outputs driver signal f4(($\omega_4$t). The amplitude of any given driver is about half the magnitude needed to activate a pixel. Thus, a pixel is activated by a combination of signals from two drivers, one coupled to either end of the conductive element associated with the pixel.

The time for electromagnetic waves such as driver signals, to propagate through a material (e.g., the conductive elements and associated materials) at a velocity proportional to the speed of light is given by:

$$V_{prop} = \frac{\text{velocity of light}}{\sqrt{\text{dielectric constant}}}$$

in which the dielectric constant (or permittivity) is that of the conductive elements and associated materials (or the equivalent). The velocity of light is $3\times10^8$ m/sec, and the dielectric constant of commonly used display materials will be in the range of about 3 to 10. Thus, the driver signals will travel along the conductive elements at a rate of perhaps $1.5\times10^8$ m/sec.

Because the driver signal is propagating so rapidly past each pixel, there would be insufficient dwell time to transfer enough energy to light-up any pixel completely. For example, present display technologies scan (and activate or light-up) pixels at a rate of perhaps 30 ns per pixel. Even with the serpentine configuration of FIG. 13, in a 30 cm×30 cm panel, an activation pulse would only spend 2 ns on each column or row.

Further, simply directly coupling a single drive signal to a string of pixels would result in all pixels being briefly partially activated (i.e. lit up) as the activating pulse passed over them. Consequently, it would be impossible to selectively light up only some of the pixels in this string because the same activating signal as it propagates down the string would pass over all pixels equally.

These two problems of how to select individual pixels and how to use an otherwise too rapidly propagating drive signal are solved in the present invention by using the beat-frequency difference between two driver signals as the pixel enabling signal. This difference signal dwells sufficiently long on each pixel location to deliver or transfer sufficient energy to turn the pixel on (activate) or off (de-activate). The time-varying voltage seen by a pixel in a row is determined by the amplitude and frequency the two row driver signals $f_1(\omega_1 t)$ and f2($\omega_2$t) output by row drivers $DX_1$, $DX_2$, and by the propagation time needed for the signals to reach the pixel. Similarly, column pixels see time-varying voltage signals determined by the amplitude and frequency of the two column driver signal f3($\omega_3$t) and f4($\omega_4$t) output by column drivers DY3, DY4;

According to the present invention, the display horizontal scan rate is determined by the frequency differential ($\omega_1$–$\omega_2$), and the vertical scan rate frequency differential ($\omega_3$–$\omega_4$). Further, the absolute frequencies $\omega_1$,$\omega_2$,$\omega_3$,$\omega_3$ are set proportional to the propagation delay of the medium through which the signals from $DX_1$, $DX_2$, $DY_3$, $DY_4$ travel. Video information to be displayed on display 2100 is used to modulate at least one of the row drivers and one of the column drivers. Thus in FIG. 13, modulator 2400 is coupled to driver DX1 and modulator 2500 is coupled to driver DY4. Of course modulation could instead or in addition be coupled to drivers DX2 and/or DY3.

Because the absolute frequencies $\omega_1$ $\omega_2$, $\omega_3$, $\omega_4$ are set proportional to the propagation delay of the medium, the resultant composite voltages resulting from the sum of the two row-driven voltages and from the sum of the two column-driven voltages will vary with time and with physical location on the conductive element being driven.

Figure 14A:
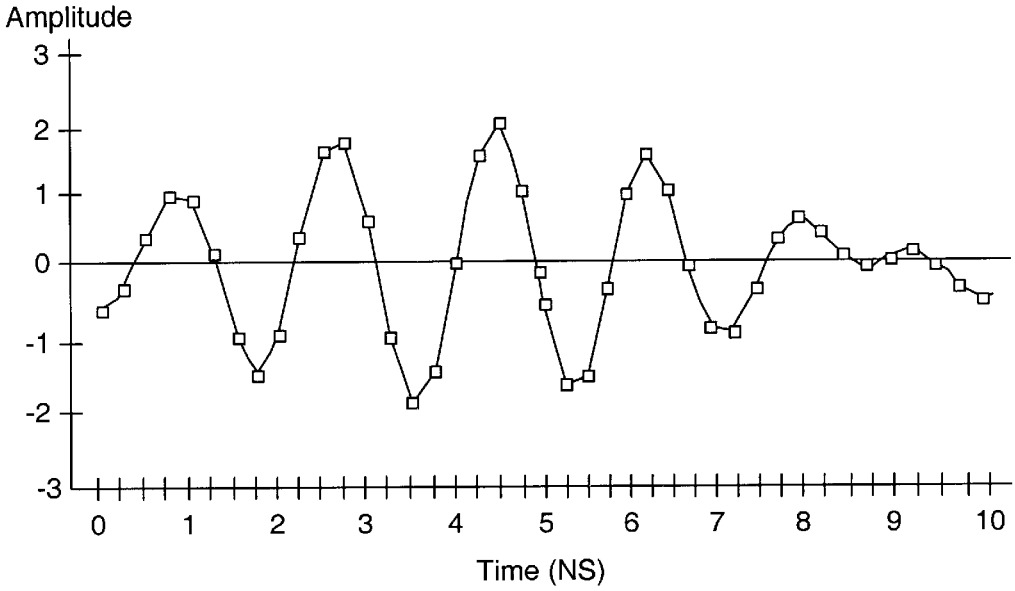
FIGS. 14A and 14B depict the time-dependent driver signal voltage present at different pixels along a conductive element.
Figure 14B:
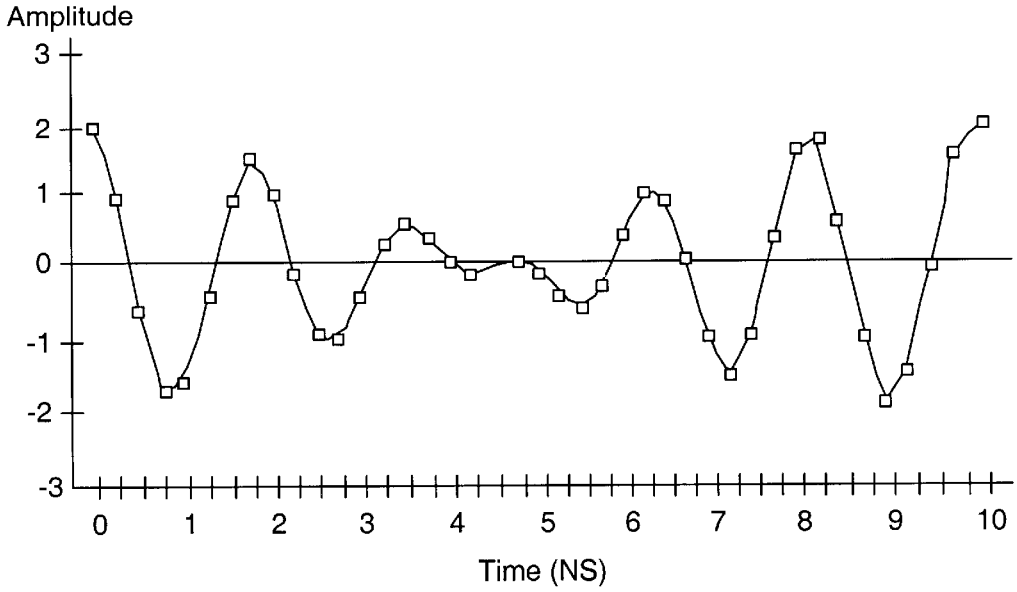

Consider now the pixel driver waveforms shown in FIGS. 14A and 14B. Assume that nine pixels are connected-together in series by a conductive element having a voltage driver coupled to each end of the conductive element, whose propagation time end-to-end is about 1 ns. Assume that adjacent pixels are spaced apart a distance 18 mm, and that the voltage drivers output respective signals f1($\omega_1$t) and f2($\omega_2$t), wherein each signal is 1 V peak-peak, e.g., a voltage peak-peak magnitude that is too low for an individual driver signal to activate a pixel.

According to the present invention, the period of each voltage driver signal is made approximately comparable to the conductive element propagation time. By comparable it is meant that the period is within about ±100%, the period being twice the propagation time in the present example. Thus, if the conductive element propagation time is 1 ns, let $\omega_1$=500 MHz, and $\omega_2$=600 MHz. This frequency relationship ensures a phase difference between f1($\omega_1$t) and f2($\omega_2$t) sufficient to cause each pixel to see a combined driver signal that differs significantly at each location in the pixel string. Since the two driver signals are originating from different locations relative to any given pixel, their signal summation will differ at any particular pixel location at the same instant of time.

FIG. 14A shows the time-dependent voltage present at the first pixel in the string, e.g., the pixel closest to driver signal f1($\omega_1$t), and FIG. 14B depicts the voltage present at a pixel mid-way between the first and last pixel in the pixel string. Note that these voltages have the form of an amplitude modulated sinewave in which the high frequency carrier has an amplitude "envelope" representing the low frequency difference between the two driver signals. In this example, the envelope frequency is indeed about 100 MHz, e.g., (600 MHz−500 MHz).

According to the present invention, the rate of change of the envelope is independently set by selecting the frequency difference between the two driver signals. However, the absolute frequency of the two driver signals is set proportional to the propagation delay of the medium through which they travel. In this manner, individual pixels are addressed at a reasonably slow rate.

It is apparent from examination of FIGS. 14A and 14B that voltage maxima traverse left and right with a period that is proportional to the difference in periods between the two driver voltage waveforms, e.g., $1/\omega_1$, and $1/\omega_2$. Indeed, this phenomena is present even if the display is implemented not with discrete row and column conductive elements, but with overlying planes.

Figure 15:
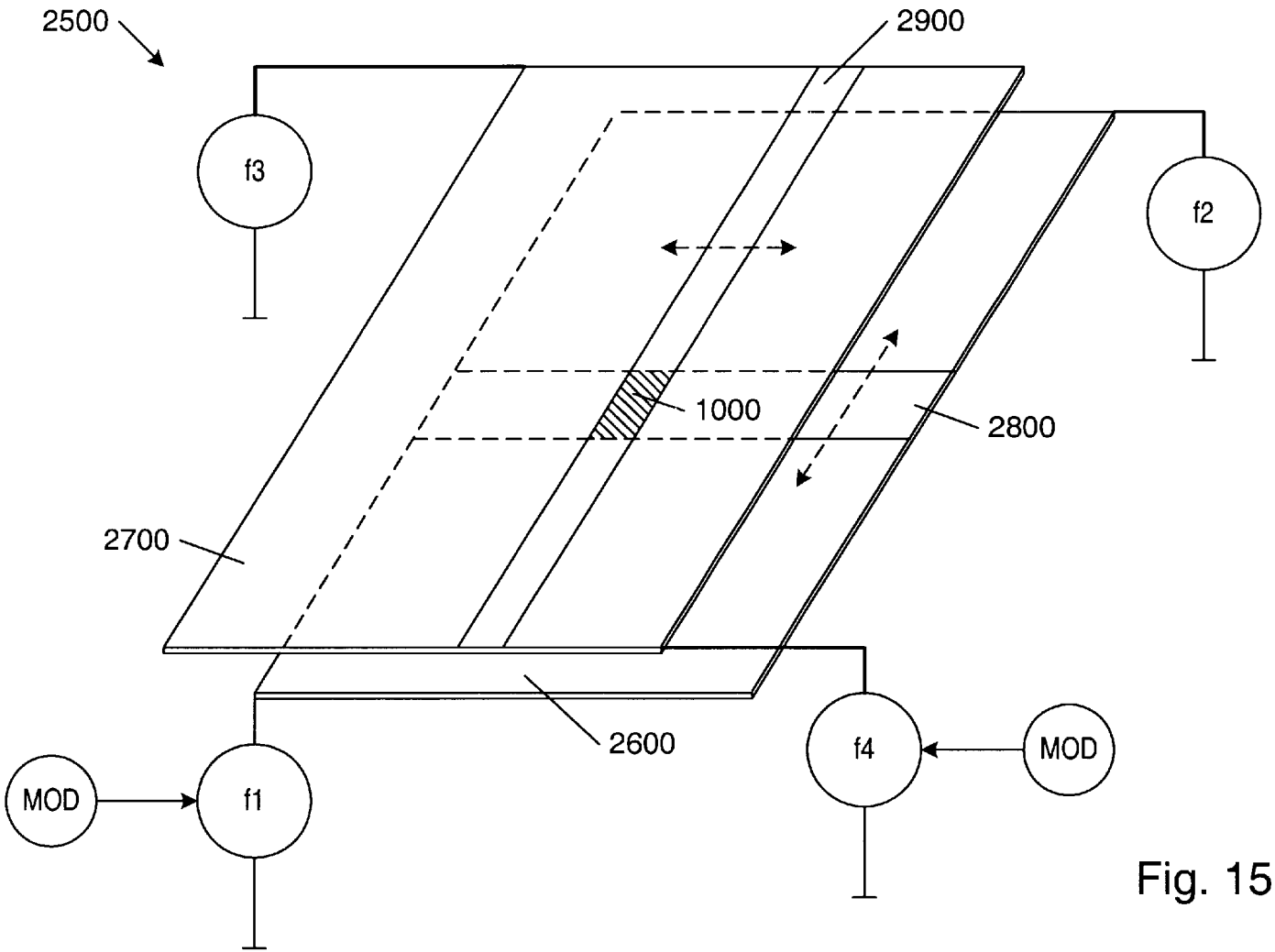
FIG. 15 depicts an embodiment in which time-dependent drivers are coupled between first and second conductive planes.

FIG. 15, for example, depicts a display 2500 as comprising a first plane 2600 containing pixels that are addressed by drivers f1 and f2 and an overlying second plane 2700 containing pixels addressed by drivers f3 and f4. (For brevity, the FIG. 15 notation f1 is understood to stand for f1($\omega_1$t), etc.). In this embodiment, first plane 2600 is the row conductive element, whose first and second ends are two opposite diagonal portions of the plane. Similarly, plane 2700 is the column conductive element, whose first and second ends are two opposite diagonal portions of the plane.

In FIG. 15, the driver signals are selected according to the above-described criteria. As the f1 and f2 signals vary with time, a horizontal band 2800 of pixels is addressed, and as the f3 and f4 signals vary with time, a vertical band 2900 of pixels is addressed. The time-motion of these two bands is depicted in FIG. 15 by phantom double-arrowed lines. Only pixels lying at the time-varying intersection 1000 of moving bands 2800, 2900 will be active at any given time.

Regardless of whether serpentine conductive elements, or conductive planes are utilized in a video display, the preferred enabling waveform is not a sinusoid, but rather a digital pulse train. However, the above-described principals still apply. The width of the digital pulses will be proportional to the pixel area that is to be enabled.

Assume again that nine pixels (spaced-apart a distance 110 cm) are series-connected by a conductive element having a digital voltage driver coupled to each end. Let each voltage driver have an output impedance of R Ω, and let the voltage drivers output respective digital pulse signals f1(t) and f2(t) that are perhaps 5 V peak-peak. Assume that the end-end conductive element propagation time is now 6 ns, and thus the time to propagate from pixel to adjacent pixel is about 0.75 ns. Let f1(t) and f2(t) each output a pulse train having logic "1" level pulses for about 1 ns.

In the present digital example, at any pixel location along the pixel string, the voltage will be the continuous sum of the two source voltage waveforms. Assume that a pixel is active (e.g., on) when the voltage at the pixel node location exceeds about 3 VDC. Let the period of f1(t) be 6 ns, and the period of f2(t) be 5.64 ns, such that the period differential yields a scanning period of 94 ns. Thus, $1/\text{period}_{diff}=1/(5.64\text{ ns})-1/(6\text{ ns})$. These waveform characteristics demonstrate the presence of a beat frequency that is lower than the two source frequencies.

Figure 16:
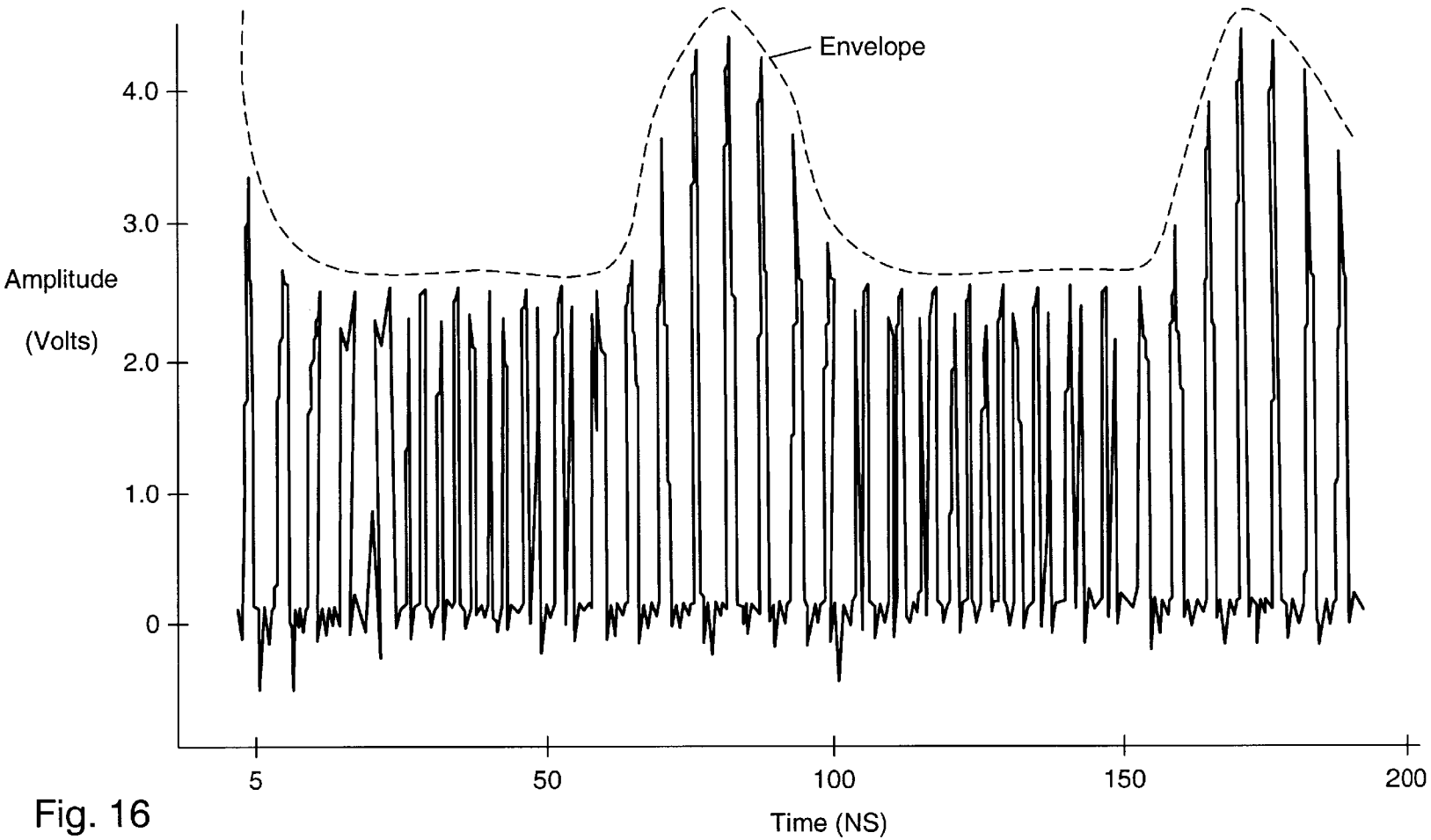
FIG. 16 depicts the amplitude band type envelope produced when beating digital pulse trains whose period differential corresponds to a desired envelope period.

FIG. 16 depicts the composite voltage waveform, at the first node (and also the last node) in the exemplary string of nine pixels. Note that two unique locations experience a voltage exceeding about 3 VDC at any given time, these locations being symmetrical about the central pixel node. Note in FIG. 16 that the envelope of the high frequency pulses has a period of about 94 ns, e.g., a period corresponding to the differential in the frequency of the two input voltage sources f1(t) and f2(t).

Figure 17:
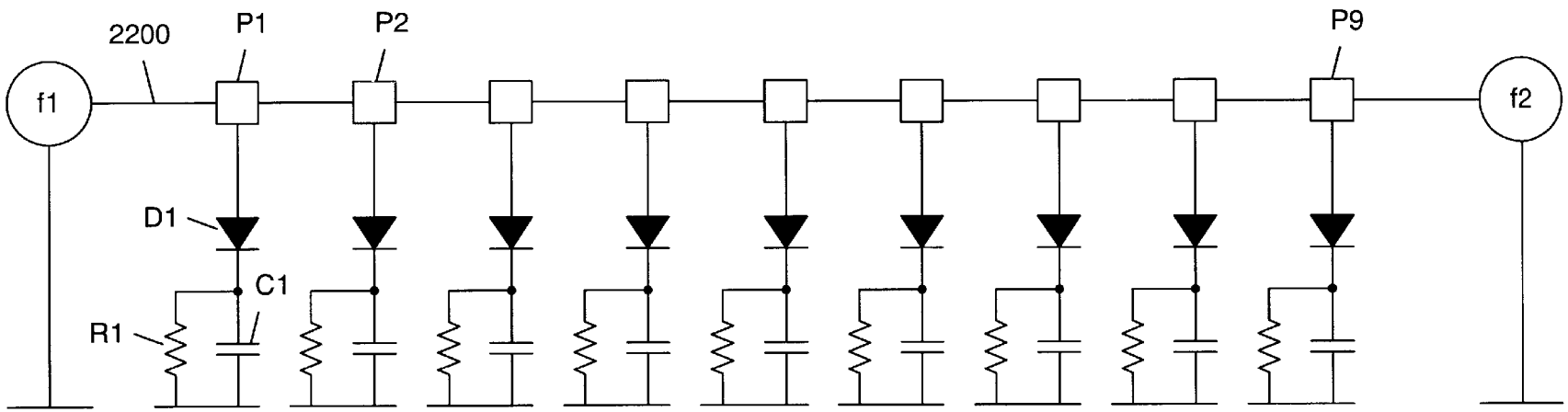
FIG. 17 depicts the optional use of rectifying diodes in a display.

For a cathode ray tube ("CRT") type scanning system, the vertical frame rate is scanned at about 60 Hz, which means the differential in frequency between the f1(t) and f2(t) voltage sources should be 60 Hz. In practice, the summed or composite signal at each pixel node may require rectification to produce a continuous pulse that turns on the pixel. If required, a common diode $D_N$ may be implemented per pixel $P_N$, as shown in FIG. 17. The $R_NC_N$ low pass filter associated with each diode rectifier may be implemented using stray capacitance and resistance in the array structure. In an existing TFT LCD, each pixel diode may simply be the emitter-base junction of the existing thin film transistor. In any event, it will be appreciated that fabricating a diode rectifier per pixel (if needed) is less burdensome than implementing an active TFT driver per LCD pixel, in terms of cost, yield, and overall reliability.

Alternatively, the diode may be implemented per row or per column, replacing a row or column driver, instead of replacing a pixel driver, if a separate propagation path is used.

Figure 18A:
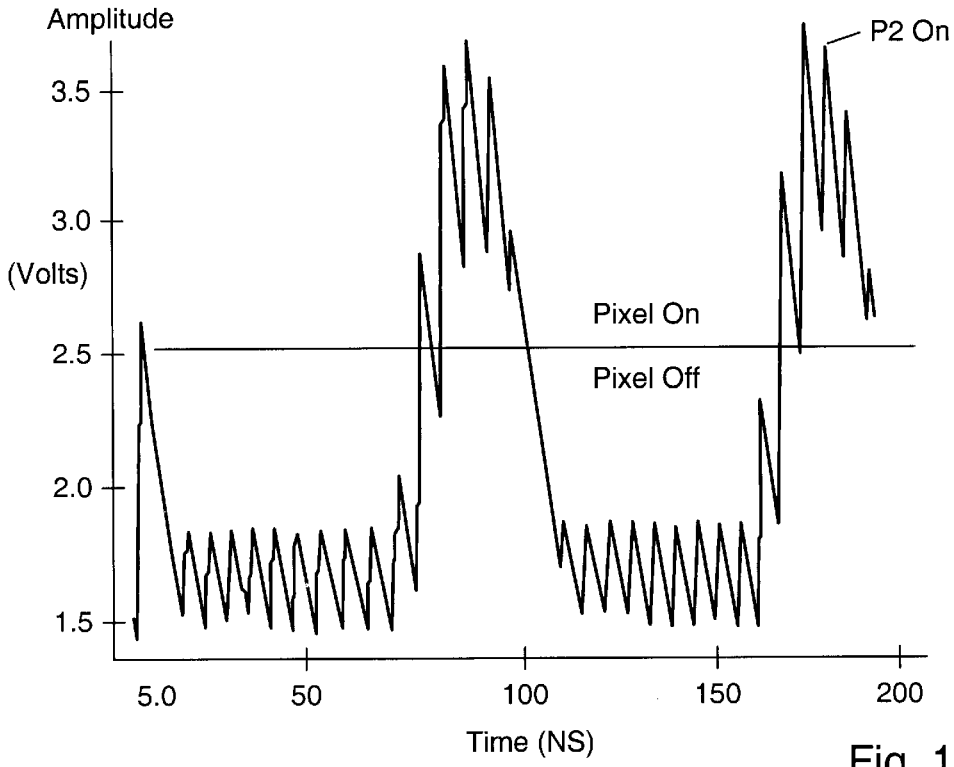
FIGS. 18A, 18B and 18C depict rectified driver signals present at different pixel node locations for the exemplary configuration of FIG. 17.
Figure 18B:
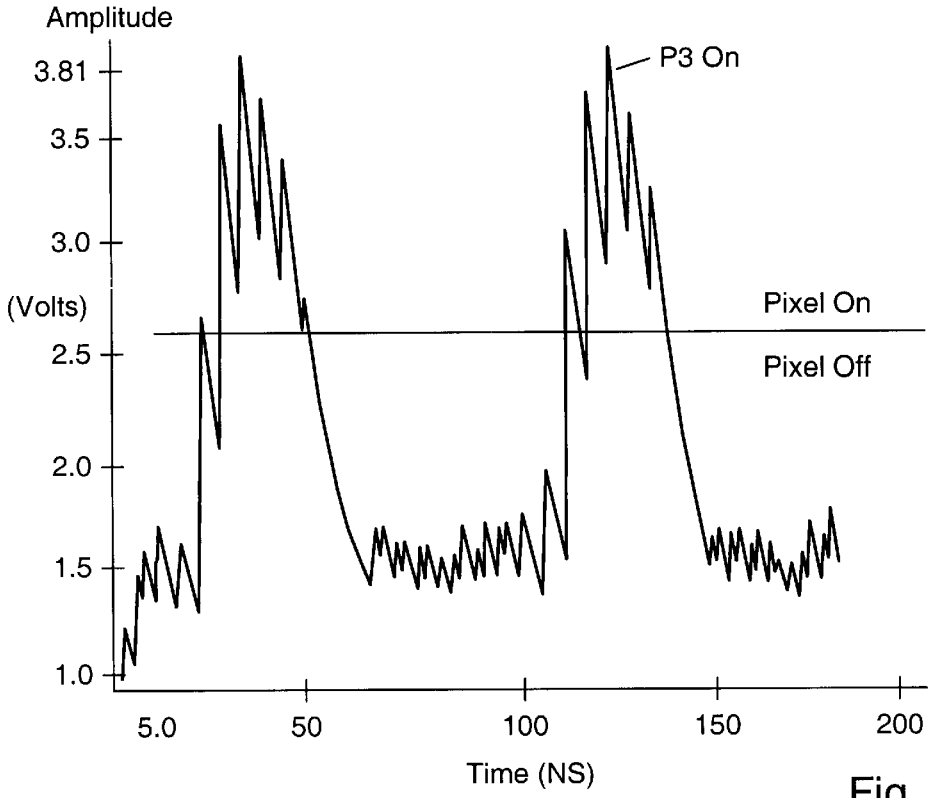
Figure 18C:
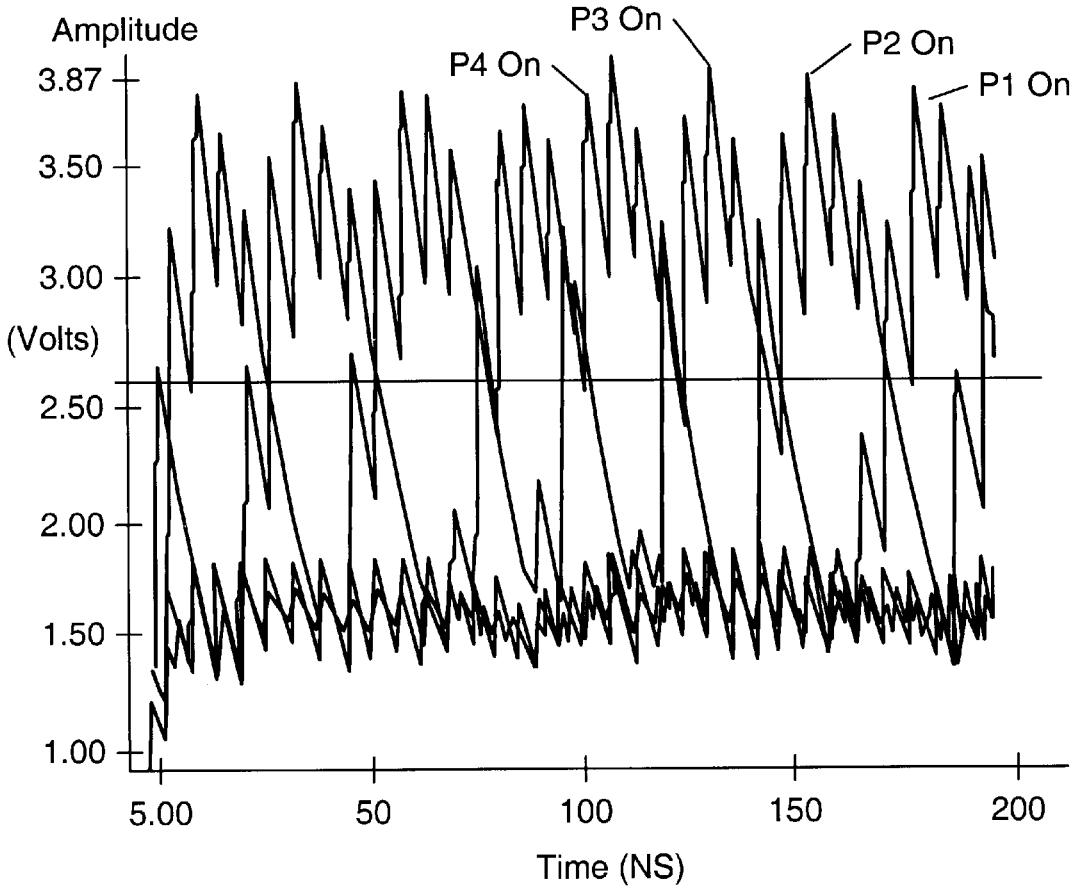

FIGS. 18A and 18B depict rectified driver voltages at pixels P2 and P3 in the simplified nine-pixel configuration shown in FIG. 17. When the rectified voltage is "high" slightly above 2.5 VDC in this example, the pixel is active or turned on, and when the voltage is "low" or below about 2.5 VDC, the pixel is inactive or turned off. The period of the amplitude peaks is again about 94 ns, as intended. A comparison between FIGS. 18A and 18B shows that pixel P3 turns on at a different time than pixel P2. FIG. 18C depicts the sequential activation of pixels P4, P3, P2, P1 for the simplified configuration of FIG. 17. Note that the pixels are sequentially turned on using only two drivers, but respond as though they were discretely addressed using a plurality of drivers, as in the prior art.

Figure 19A:
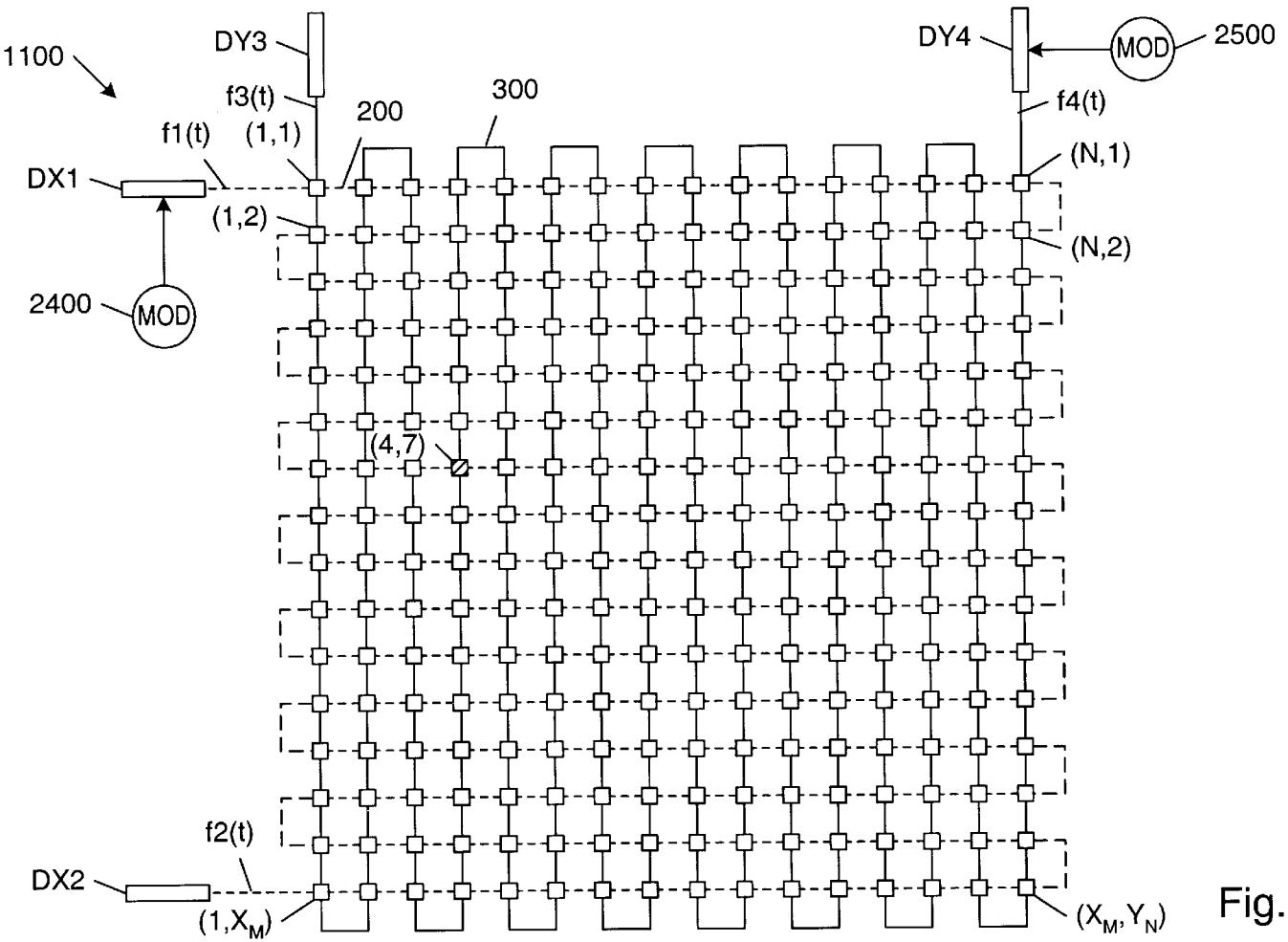
FIG. 19A is a block driver of a display comprising M×N pixels, driven by a total of four digital drivers.
Figure 19B:
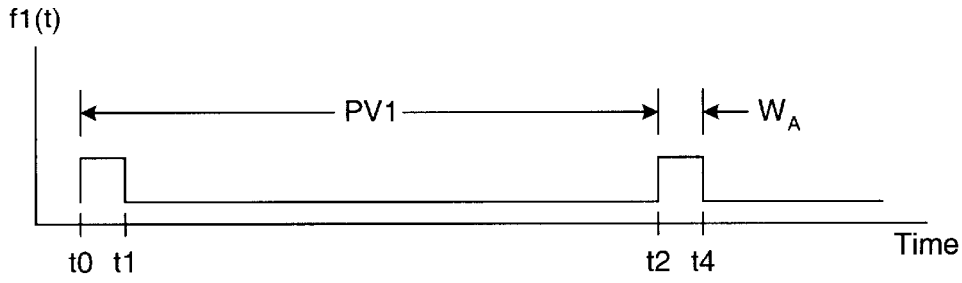
FIGS. 19B, 19C, 19D, 19E depict preferred time relationships between the digital drive signals for the embodiment of FIG. 19A.
Figure 19C:
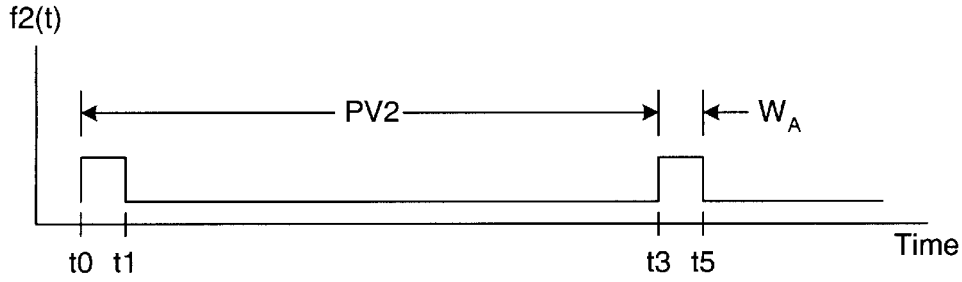
Figure 19D:
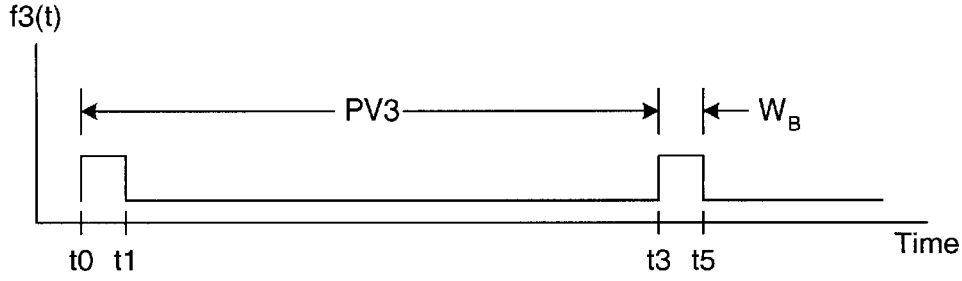
Figure 19E:
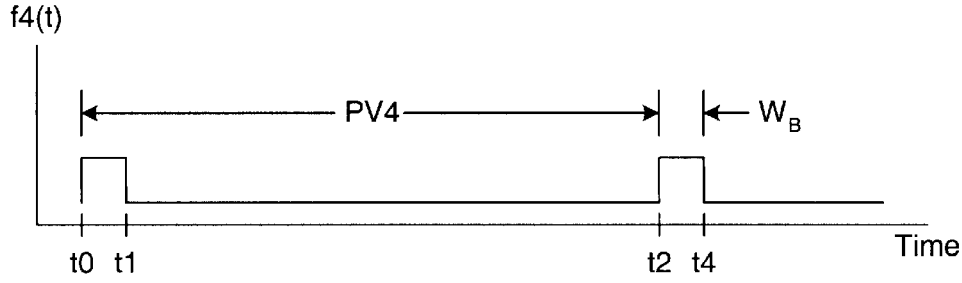

FIG. 19A depicts a preferred embodiment of a display 1100 that is similar to what was depicted in FIG. 13, except that row drivers DX1, DX2 and column drivers DY3, DY4 each output respective digital pulse train driver signals f1 (t), f2 (t), f3 (t), f4 (t) rather than sinusoidal waveforms. Each of the driver signals produce half the voltage magnitude required to enable a pixel. As shown, conductive elements 2200 and 2300 preferably are perpendicular serpentine grids of wire.

The periods of signals f1(t) and f2(t), PV1 and PV2 respectively, preferably are separated by Y (Hz), and the amplitude of f1(t) and/or f2(t) may be amplitude modulated by the desired video signal. The periods of signals f3(t) and f4(t), PV3 and PV4 respectively, preferably are separated by X (Hz), and either or both of these signals may also be modulated by the desired video signal. Further, the relative roles of each pair of drivers outputting the driver signals may be interchanged, if desired. The phase of each driver signal may be controlled to simplify video memory timing, if desired. Such phase control is known in the art and will now be detailed herein.

In a typical video display, information is read out from a video random access memory ("VRAM") sequentially under the control of a vertical and horizontal synchronization signal. The beam or image refresh sweeps from the top left comer of the screen, moving from left to right and from top to bottom. Each pixel on the screen has a corresponding byte of information in the VRAM. In the present invention, the peak of the scanning enable band occurs when the sum of the two source drivers are both high. In FIG. 19A, by setting the phase of DX1 to start at the peak voltage at T=O and by setting DX2 to start at the midpoint between peaks, the amplitude band will be a maximum on row #1 at T=O, given that the propagation time of the serpentine row electrode is ½ the period of DX2. The pulse that starts DX1 is the equivalent of the vertical sync signal in a conventional display. In common digital logic, the vertical sync signal would reset a counter that generates the DX1 signal. In an identical fashion, horizontal sync is used to synchronize the start of the DY3 and DY4 sources.

The frequency separation between f1(t) and f2(t), e.g., the respective repetition rates, is set by the desired vertical refresh rate for display 1100. In present day display systems, the vertical refresh rate typically is in the range of about 60 Hz to about 120 Hz, although other frequencies could of course be implemented by properly selecting the frequency separation.

FIGS. 19B, 19C, 19D and 19E depict the timing relationships between f1(t), f2(t), f3(t) and f4(t) for the embodiment of FIG. 19A. The combined f1(t) and f2(t) signals sequentially enable each row of pixels, and the combined f3(t) and f4(t) signals sequentially enable each column of pixels. The amplitude of any or all of these driver signals is modulated by the video information to be displayed, to define whether an addressed (e.g., enabled) pixel is lit or not lit.

The period PV1 of f1(t) preferably is approximately equal to 2*N*T props, where N is the number of rows, and T prop is the propagation delay. The period difference (PV1–PV2) is set by the desired vertical scanning rate for the display. For a vertical scan rate having a 60 Hz refresh cycle, (PV1–PV2)=1/60 (sec.)≈16.7 ms. The period difference (PV3–PV4) is set by the desired horizontal scanning rate, which is typically determined by the type of display element used, e.g., LCD, plasma, cold cathode, etc. For a 10 KHz horizontal scanning rate, (PV3–PV4)=1/10,000≈100 $\mu$S.

The pulse width $W_a$ associated with f1(t) and f2(t) pulses is the row enable pulse width, and will be comparable to the propagation time of the physical width of the display, 15" (38 cm), for example. For a 38 cm wide display, $W_a$ would be about 2.5 ns. The pulse width $W_b$ associated with f3(t) and f4(t) pulses is the column enable pulse width, and will be comparable to the propagation delay of the physical height of the display, 11.5" (29.2 cm), for example. For a 29.2 cm high display having typical dielectric materials, $W_b$ would be about 2 ns. As the display area is increased, the drive circuitry implementing DX1, DX2, DX3, DX4 becomes simplified because the pulse widths $W_a$ and $W_b$ become wider, e.g., longer in duration.

Figure 20:
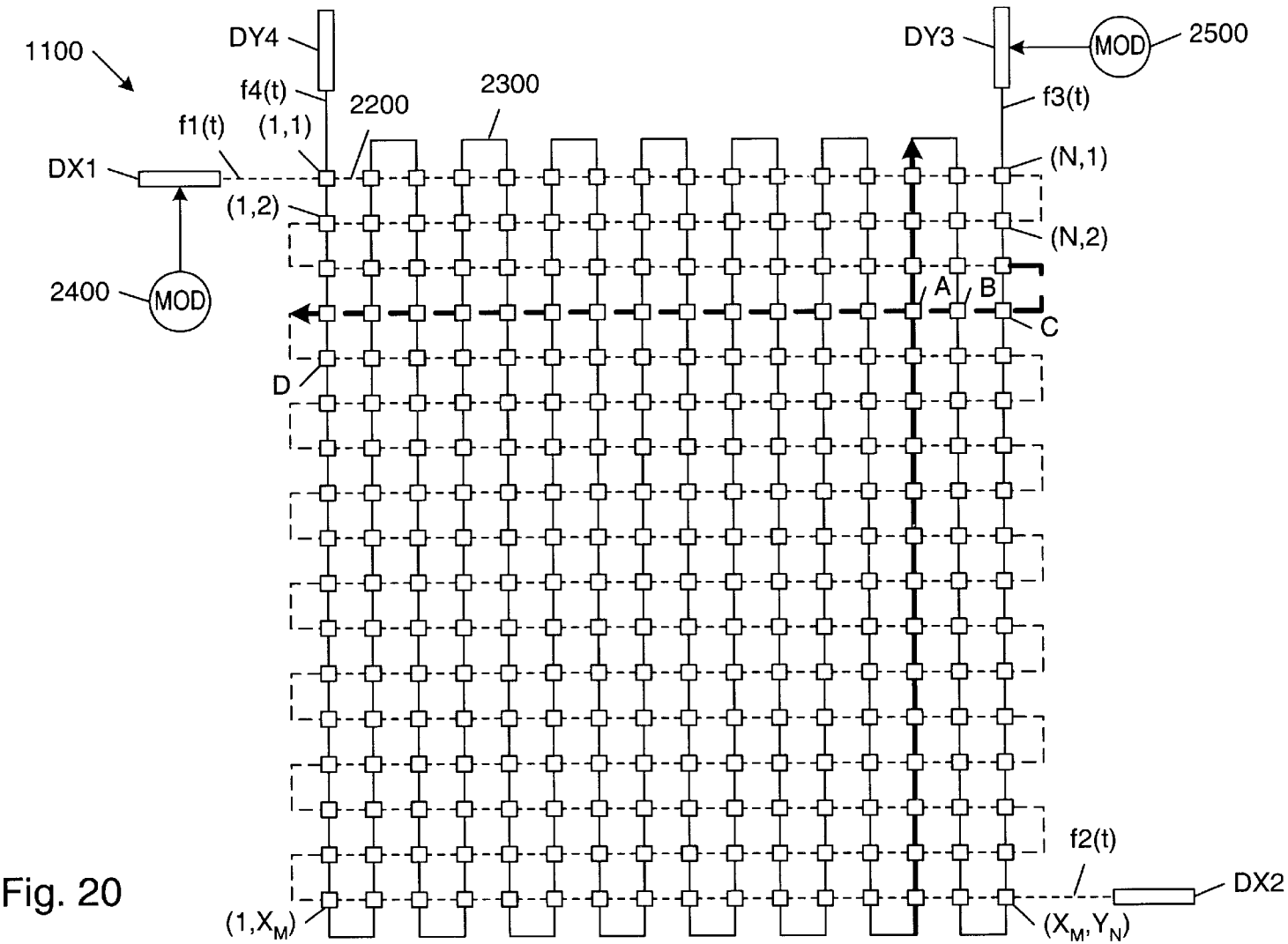
FIG. 20 depicts a sample scanning sequence for a display using four drivers.

FIG. 20 depicts a sample scanning sequence, according to the present invention, and depicts the travel of the combined row and column select amplitude enable bands. The bands are depicted as heavy row and column lines, and will be found at a location where the amplitude envelope of f1(t)+f(2) is high, and where the amplitude envelope of f3(t)+f4(t) is high. In this example, it is assumed that f1(t) is a higher frequency than f2(t), and thus the scanning direction is away from the higher frequency source toward the lower frequency source. Similarly, it is assumed that f4(t) is a higher frequency than f3(t), and thus the scanning direction is also in a direction away from f4(t) toward the lower frequency f3(t). In FIG. 20, pixel A is presently lit up, and pixel B will be the next pixel addressed, after which pixel C and then pixel D will be addressed.

Figure 21:
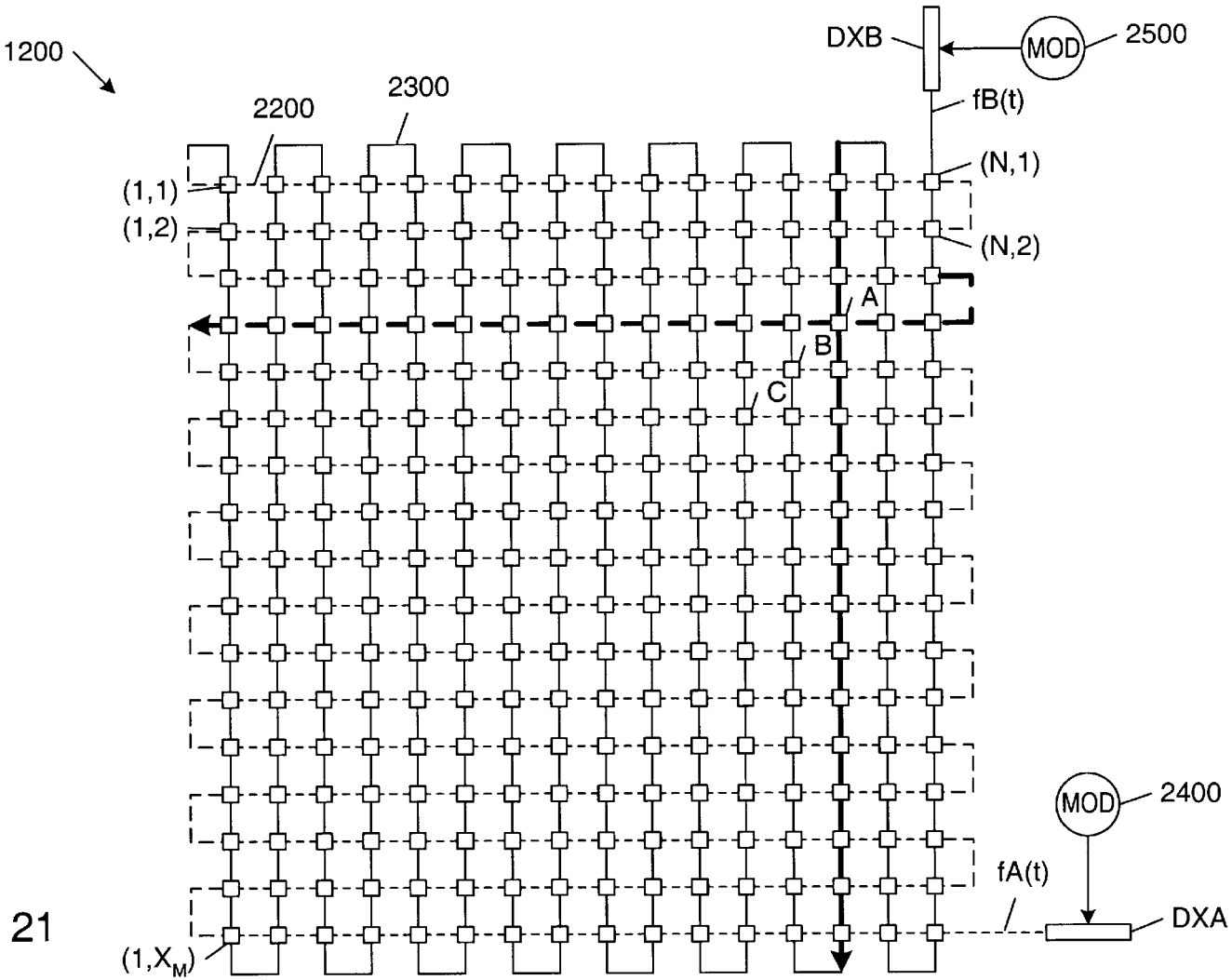
FIG. 21 depicts a sample scanning sequence for a display using two drivers.

FIG. 21 depicts another embodiment of the present invention, wherein only two drivers DXA outputting fA(t) and DXB outputting fB(t) are used to drive display 1200. The preferably serpentine conductive elements 2200 and 2300 are series-coupled at their non-driven ends. In this embodiment, the active pixel is scanned diagonally, e.g., pixel A, then pixel B, then pixel C. The starting phase of f1(t) relative to f4(t) defines which diagonal "line" is scanned.

In the various described embodiments of the present invention, it is to be understood that the display in question may be monochrome or color, and may be implemented using techniques other than liquid crystal, for example, plasma, cold cathode, among other technologies. In a color display, the pixels shown in the various embodiments herein may be considered to be separate arrays of red, or green, or blue pixels. Alternatively, the pixels in an array in an embodiment described herein may be considered to be alternating combinations of red, green, and blue pixels, e.g., different colored pixels in the single array shown in the figures. In the various LCD embodiments, the present invention provides a response and contrast ratio commensurate with that provided by more expensive active matrix displays, TFT for example. However, this performance is attained without the thousands of drivers needed in prior art implementations, and without the expense and yield difficulties associated with implementing literally millions of per-pixel thin film transistors. In a plasma or cold cathode display where each of thousands of drivers must be relatively high voltage units, the cost savings provided by the present invention is even more dramatic.

Parallel Column Addressing

Some display technologies may require that all columns in a selected row be addressed in a very short time period. For example, some plasma display technologies may have such a requirement. The shorter time period for column addressing may arise from the nature of the display technology or from a requirement that each row be scanned multiple times during a refresh period to create different intensities for such applications as gray scale displays. The beat-frequency techniques described above may not be feasible for addressing the columns when such short time periods are required by the display technology. For example, if all columns must be selected for each row in a very short time period it may be difficult to impart enough energy to each column to properly activate the display elements using the beat frequency techniques described above. An 853×480 pixel display in some technologies may allow only 2.5 microseconds per row to address the 853 columns.

Figure 22:
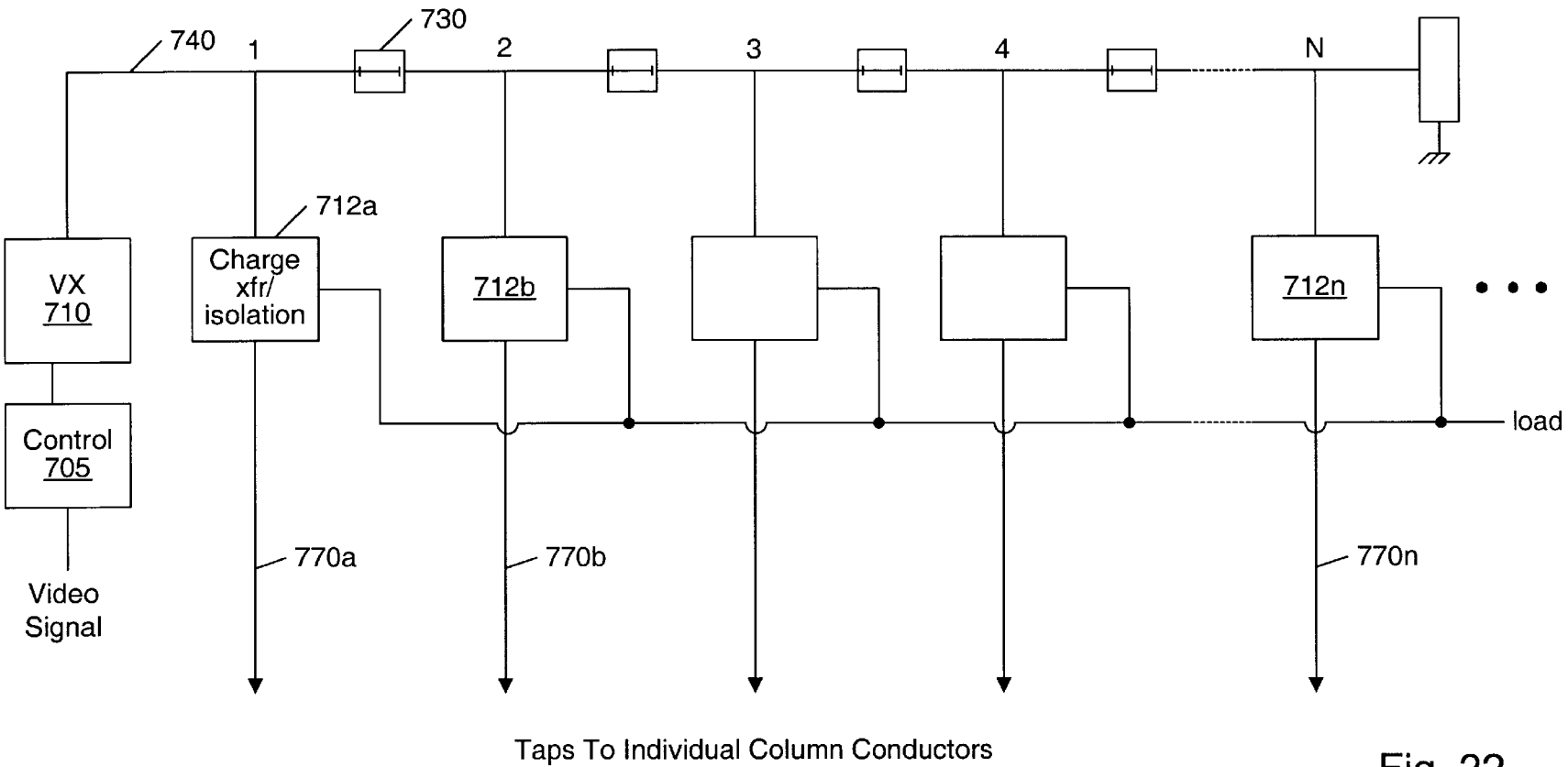
FIG. 22 illustrates an apparatus to simultaneously address all columns.

A solution to the above noted problem is illustrated in FIG. 22. A video driver 710 may drive a pulse train on display conductor 740. Each pulse of the pulse train may correspond to a pixel on a row to be selected. A high voltage pulse may indicate that the pixel is to be "on" and a low voltage pulse may indicate that the pixel is to be "off". The display conductor may be terminated by termination device 708, which may match the characteristic impedance of the display conductor to minimize reflection. Tap-off point A-N are located along display conductor 740. A propagation delay between each tap-off point is represented by delay element 730. Delay element 730 may be circuit board trace, a discrete delay element, or other delay associated with display conductor 740 between tap-off points. The width of the pulse of the video pulse train driven on display conductor 740 may be approximately equal to the propagation delay between tap-off points such that when the leading pulse reaches that last tap-off point N, a different pulse is present at each tap-off point corresponding to a row of pixels to be selected. Control circuitry 705 controls the pulse train according to a video data signal.

The voltage differential of the pulse train driven on display conductor 740 may correspond to the voltage differential to be applied to column conductors 770. When the leading pulse of a pulse train for a given row has propagated to the last tap-off point, a charge from each tap-off point is transferred to the corresponding column conductor 770 by a charge transfer/isolation circuit 712. A load signal may be driven to each charge transfer/isolation circuit to enable the charge transfer. Note that in one embodiment if the corresponding pixel is to be "off", no charge is transferred by circuit 712, and if the corresponding pixel is to be "on", a charge necessary to place the column conductor at the appropriate voltage to activate the pixel is transferred. The width of the load signal may be approximately less than or equal to the pulse width of the pulses of the video pulse train on display conductor 740. This is to ensure that the charge for only one pulse is transferred.

Once charge transfer is complete, the load signal is deasserted. While the load signal is deasserted, the column conductors 770 are isolated from the display conductor 740. During this isolation time, a new pulse train corresponding to the next pixel row is being propagated down the display conductor. Also during this isolation time, the transferred charge is being applied to the individual column conductors without being affected by the new pulse train. Note that the pixel rows are not illustrated for sake of clarity. The rows may be selected by any row addressing technique. In a preferred embodiment, a beat frequency techniques is used to select the rows.

Figure 23:
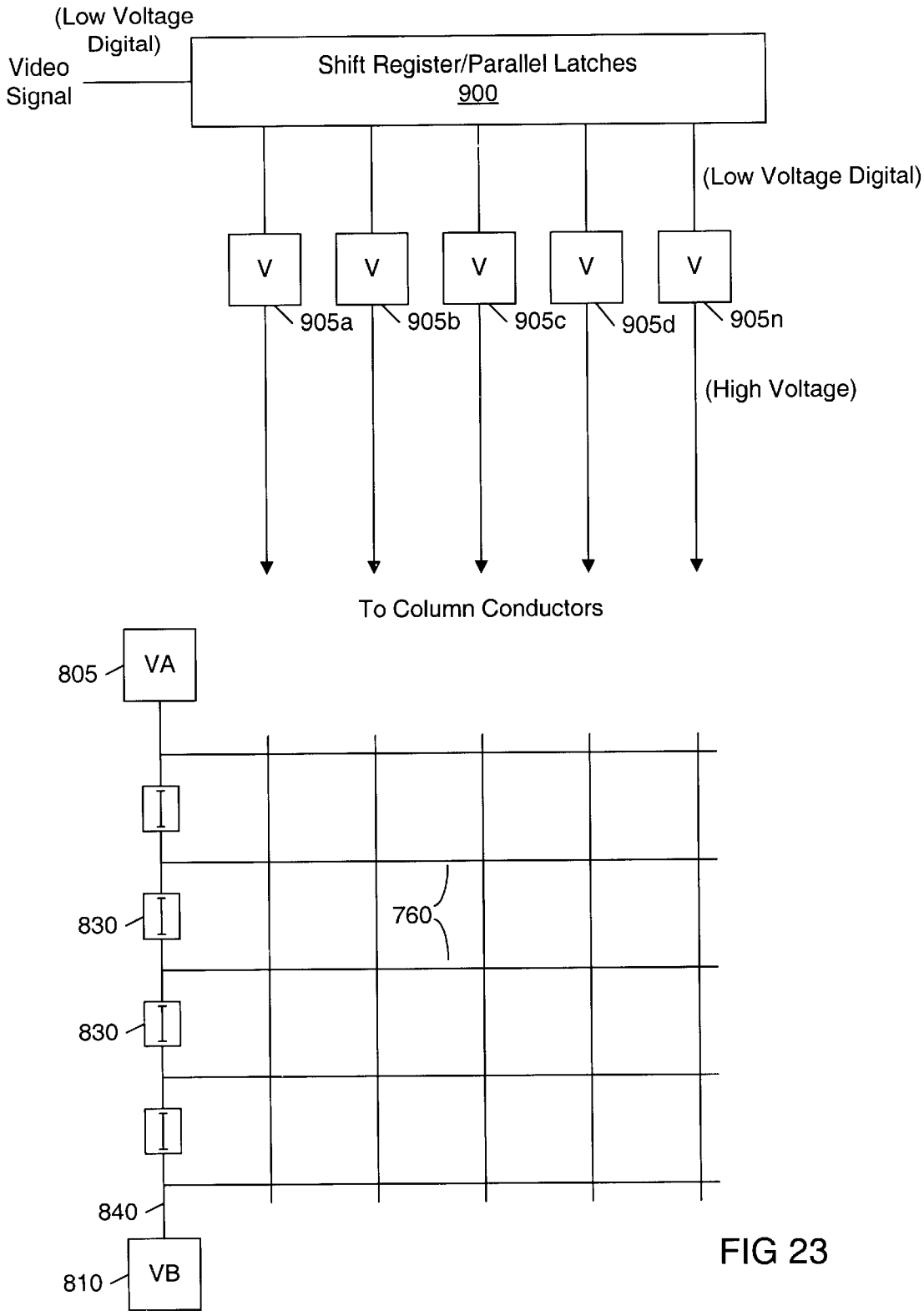
FIG. 23 illustrates an apparatus using a parallel column addressing mechanism.

Turning now to FIG. 23, a preferred implementation of a parallel column addressing mechanism is shown. Note that the terms "column" and "row" are not limiting and the techniques described herein may be applied for addressing either columns or rows or both. Each row of the display matrix may be selected according to a beat frequency method, such as described above in FIGS. 2–21. For sake of clarity some details are not shown in FIG. 1, such as the individual pixel elements and termination components at the end of each row. However, it is understood that such components may be present. Each row 760 may be tapped off of a display conductor 840. The display conductor 840 is driven at each end by a display driver 805 and 810, respectively. Between each row tap is a delay element 830. As described above the delay element 830 may include circuit board trace, such as in a serpentine matter, or discrete components, such as an LC component or some other delay device. A pulse train is driven at each end of display conductor 840 by the drivers 805 and 810, respectively. The period of the pulse train is approximately equal to or greater than the propagation delay for the length of display conductor 840 from the first to last tap-of points. The width of each pulse may be approximately equal to the propagation delay between adjacent row taps. Thus, a pulse from driver 805 will sum with a pulse from driver 810 at only one row tap at a time at a sufficient voltage level to select the given row. The frequency between the two pulse trains is different so that the point at which the pulses sum to select a row changes at a rate proportional to the frequency difference or beat-frequency.

Instead of selecting both the rows and the columns by a beat frequency technique, such as in FIG. 13 above, the columns in FIG. 23 are addressed according to a parallel technique. The video data to be displayed on a given row of pixels is shifted in to a series of shift registers and parallel latches 900. While the data is being driven to a currently selected row by drivers 905 the data for the next row of pixels is being shifted in to the shift register/latches 900. The shift register/latches 900 function essentially as a serial to parallel converter. When a new row is selected the data for that row is simultaneously latched in parallel onto the inputs of each of the column drivers 905. The column driver 905 inputs provided from the shift register/latches 900 are typically low voltage digital signals (as is the video data signal shifted into the shift register/parallel latches 900). Column drivers 905 amplify the low voltage input signal to a high voltage to drive the column so that if the voltage differential between a particular column and row is above the display element threshold the display element is eliminated or activated. Thus, each row may be selected by the afore described beat frequency technique. However, the columns are simultaneously driven in parallel for each selected row. Driving the columns approximately simultaneously in parallel allows each column to be activated at the appropriate amplitude for a period of time approximately equal to the row select time such that the requirements of the display technology may be satisfied. However, it is noted that this technique requires a series of low voltage digital shift registers and latches and a high voltage amplifier driver for each column. Having the shifter register/parallel latch logic and high voltage drivers for each column conductor increases the cost and complexity of the display driver apparatus as compared to the pure frequency techniques described above.

Figure 24:
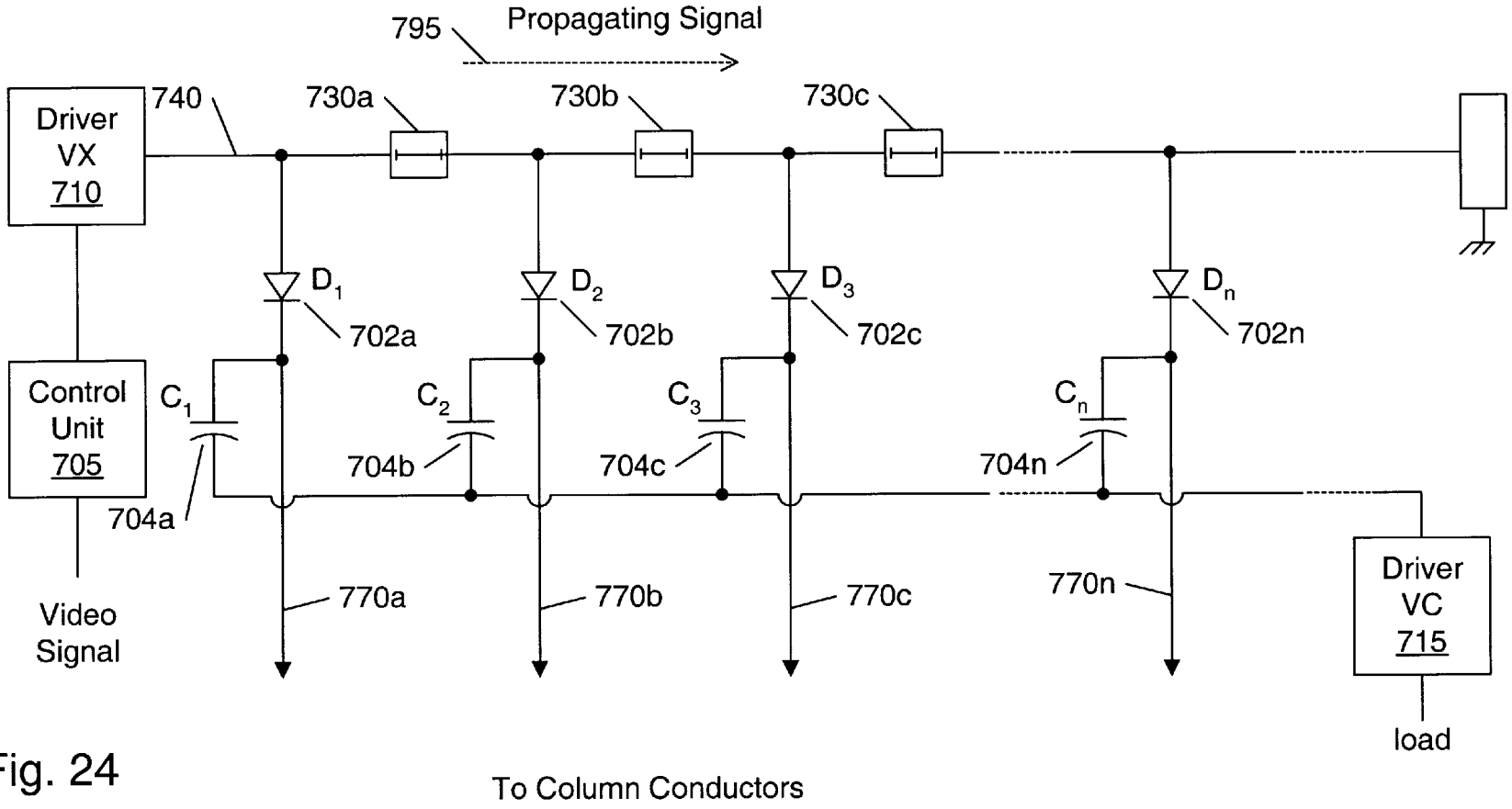
FIG. 24 illustrates another parallel column addressing mechanism for the apparatus in FIG. 23.

Turning now to FIG. 24 a column driving technique is illustrated that reduces the complexity and/or cost of driving the columns simultaneously in parallel as in FIG. 23. The technique illustrated in FIG. 24 does not require the digital shift registers and latches nor does it require a high voltage amplifier driver for each column. Instead, a display conductor 740 is provided having column tap conductors 770. A delay element 730 is present between each column tap 770. The delay element 730 may be similar to the delay elements described above. For example, the delay element may include circuit board trace such as in a serpentine manner or discrete LC components or other delay components. Driver 710 outputs a pulse train corresponding to the pixel data for a given row onto the display conductor 740. The driver 710 may be controller by control unit 705 which receives a video data signal. Reference number 795 illustrates the direction of propagation of the pulse train output from driver 710. The propagation delay for the display conductor 740 for a given pulse of the pulse train to travel from the first column tap 770*a* to the last column tap 770*n* may be approximately equal to the address period for each row. Thus, while a current row of pixels is being driven by column conductors 770, a pulse train for the next row is being driven by driver 710 down display conductor 740.

The voltage differential of the pulse train signal driven on display conductor 740 is approximately equal to the voltage differential that must be driven on the column conductors to activate the display pixels. When the pulse train for the next row has reached the last column tap on display conductor 740, a load pulse may be driven by load driver 715 in order to transfer the appropriate signal to the column conductor 770. To further illustrate the operation of the parallel column driver circuitry of FIG. 24, an example is given below. The voltage levels given in the example may be typical for certain display technologies, however, the parallel column driver illustrated in FIG. 24 is not limited to any particular voltage levels.

A diode 702 may be connected between each column conductor 770 and the display conductor 740. A separate capacitor 704 is coupled to each column conductor 770. The cathode of each capacitor is connected together to a common conductor driven by load driver 715. Load driver 715 drives the cathode of each capacitor high while the current row charge is being transferred from capacitor 704 to each column conductor 770. During this time the new row charge values for the next row to be selected are being driven down display conductor 740 by driver 710. Diodes 702 are reversed biased or off during this time so that the display conductor 740 is isolated from the column conductors 770. When the new pulse train is fully present on display conductor 740 load driver 715 lowers the voltage on the common cathodes on capacitors 704. The new row charge values are loaded on to capacitors 704 while the load driver is asserting the low voltage on the capacitors 704 cathodes. The load driver 715 lowers the capacitor 704 cathode voltage for an amount of time approximately less than or equal to the propagation delay between the column taps on display conductor 740. This is so that the row charge amount for a particular row does not spill over to the next row while the columns 770 are being loaded. When load driver 715 raises the voltage at the common cathodes for capacitor 704, the charge stored on capacitor 704 is supplied to the column conductor 770 to activate the pixels on the selected row according to the amount of charge stored on each capacitor 704. Diodes 702 are off or reversed biased during this time to isolate display conductor 740 from column 770 so that the charge values for the next row may be propagated down display conductor 740. Capacitors 704 may be discrete capacitor components. Alternatively, they may comprise the parasitic capacitance of a conductor trace since the cathodes of the capacitor 704 are all connected to load driver 715. In other words, a portion of the conductor driven by load driver 715 may overly a portion of each column conductor 770 in order to form the capacitor 704.

Figure 25:
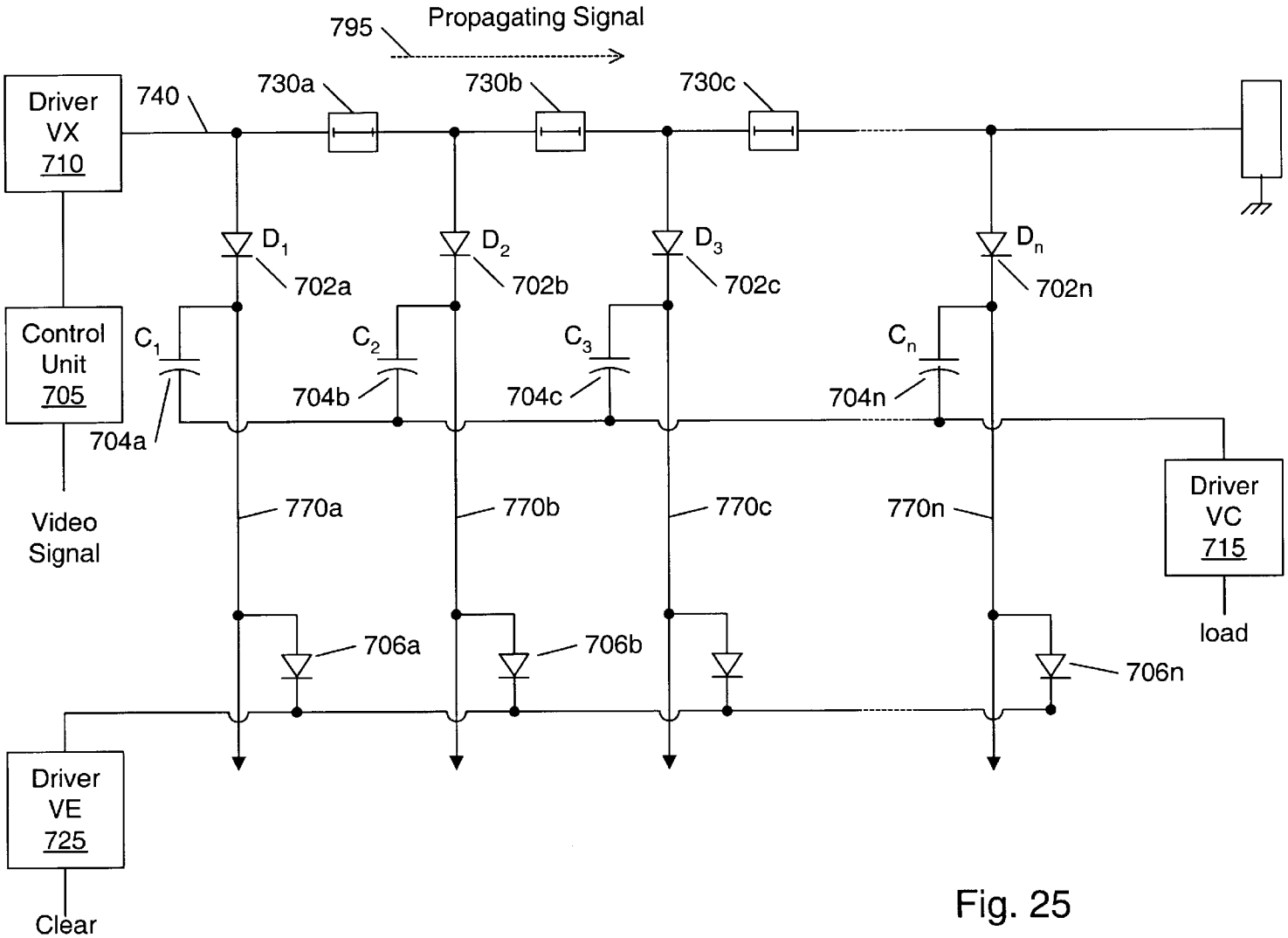
FIG. 25 illustrates a discharge mechanism for the apparatus of FIG. 24.

It may be necessary that enough charge must be pulled off each storage capacitor 704 so that each capacitor is "erased" before the next loading cycle. If the load of the column (and pixels) itself does not draw enough charge off the capacitor then a separate discharge mechanism, such as a resistor or diode, may be necessary. FIG. 25 illustrates a discharge mechanism added to the parallel column driver apparatus of FIG. 24. In this example diodes 706 are connected to each column conductor with the cathode of each diode connected together and to a driver 725 for driving a clear voltage pulse. During the time in which the charge has been transferred from capacitor 704 to column conductor 740 and the next row pulse train is being propagated down display conductor 740, the clear driver 725 asserts a high voltage to the cathodes of diode 706 so that the diodes are off or reversed biased. At the end of a row period before the next set of row charges are loaded to the column conductors, clear driver 725 deasserts the anode voltage for each diode 706 to clear any residual charge off the storage capacitor 704 prior to load driver 715 lowering the cathode voltage of capacitor 704 to load the next series of row charges. Note that the discharge circuitry of FIG. 25 may not be necessary or alternatively resistors or some other component may be used instead of diodes 706.

Figure 26:
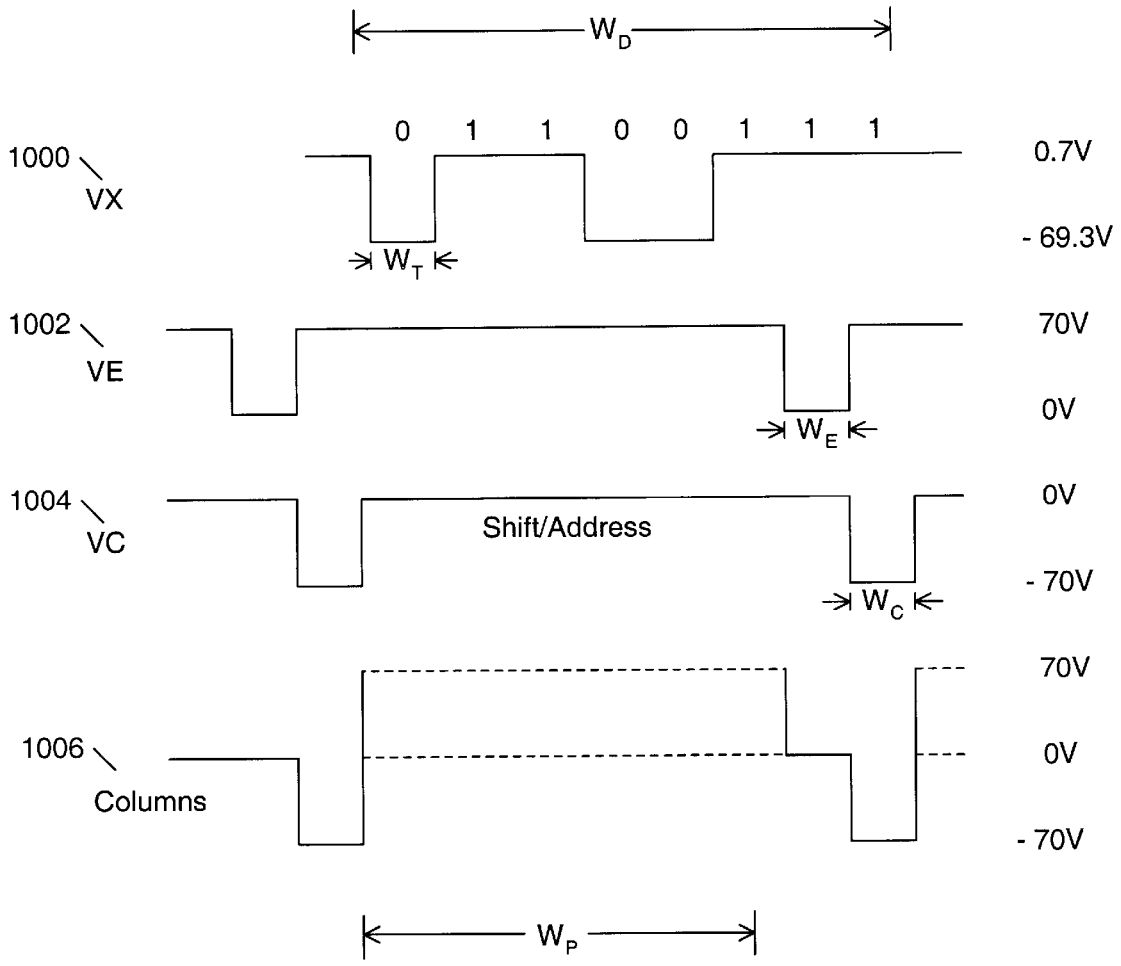
FIG. 26 is a waveform diagram for the operation of the apparatus of FIG. 25.

Turing now to FIG. 26 a waveform diagram is provided to further illustrate the operation of the display element drive mechanism illustrated in FIG. 25. Waveform 1000 illustrates a pulse train being driven during time period $W_D$ on display conductor 740. The way form 1000 shows the pulse train 01100111 being driven during the time period $W_D$. In this example it assumed that there are eight column conductor tap off points along display conductor 740 so that at the end of time period $W_D$ the pattern of way form 1000 is present on the column conductor tap off points. For example, a low voltage would be present on the column tap-off point closest to the video driver 710, followed by a high voltage on the next two tap-off points, followed by a low voltage on the two tap-off points after that, followed by a high voltage on the most distant three tap-off points from video driver 710. Time period $W_D$ may correspond approximately to the propagation delay down the length of display conductor 740 from the first tap-off point to the last tap-off point. Time period $W_D$ may also approximately correspond to the time required to scan each row of pixels in the display. The width $W_T$ of each individual pulse of the pulse train 1000 may correspond approximately to the propagation delay time between the individual tap-off points on display conductor 740. The tap-off points are located along display conductor 740 so that the propagation delay time as represented by delay element 730 is approximately the same between each adjacent tap-off point.

The pulse train represents the pattern of pixels that are to be activated for the next selected pixel row. Thus, the pulse train 1000 illustrates that from left to right on the pixel row, the pixels are to be off, on, on, off, off, on, on, on. Note that in the example illustrated in FIG. 26 the voltage swing of the pulse train 1000 is from a high of 0.7 volts to a low of negative 69.3 volts. This voltage swing and the voltage swing of the other waveforms in FIG. 26 is merely an example corresponding to a particular display technology. However, the present mechanism may be used with any suitable voltage swing as required any particular display technology. During the time period $W_D$ that the pulse train for the next row of pixels is being propagated along display conductor 740, clear driver 725 and load driver 715 are at their respective high voltage levels as illustrated by waveforms 1002 and 1004, respectively. Thus, diodes 706 are reverse biased and the charge stored on capacitors 704 is being transferred to the column conductors 770 as illustrated during time period $W_P$ at waveform 1006.

Note that the charge stored on capacitors 704 during this time period $W_P$ corresponds to the previous pulse train driven on display conductor 740. Thus, during the time the next pulse train is being propagated down display conductor 740, as illustrated during time period $W_D$, the previous pulse train is being supplied to the column conductors as illustrated during time period $W_P$. Note that during time period $W_P$, either 70 or zero volts is being supplied from capacitor 704 to each column conductor depending upon if the particular row pixel for the particular column is intended to be activated or not.

Before the pulse train of waveform 1000 is to be transferred to the column conductors, clear driver 725 drives a low voltage to the cathodes of the diodes 706 as shown at time point 1020. This serves to clear any residual charge on capacitor 704. When the pulse train reaches the end of display conductor 740, load driver 715 asserts a low voltage on the cathodes of capacitors 704. In the example of FIG. 26 −70 volts is applied to the cathodes of capacitors 704 at this point. Also at this point, the voltage at the first column tap-off point is at −69.3 volts, the voltage at the next two tap-off points is at 0.7 volts, followed by −69.3 volts at the next two tap-off points, followed by 0.7 volts at the last three tap-off points. When load driver 715 applies −70 volts to the cathodes of capacitors 704, the anode of each capacitor 704 is also pulled down by 70 volts since the voltage on a capacitor cannot change instantaneously. Thus, the diode 702 connected to the first tap-off point from display conductor 740 and the first column conductor 770 will have −70 volts at its cathode and −69.3 volts at its anode. The diode at the second tap-off point on the display conductor will have −70 volts on its cathode and 0.7 volts on its anode at this instant. Therefor, when load driver 715 applies −70 volts to the cathodes of capacitors 704, the diodes connected to the first, fourth, and fifth tap-off points will be off since the voltage difference across these diodes is only 0.7 volts (less than the turn on voltage of the diodes) and the second, third, sixth, seventh, and eighth diodes will be on since the voltage difference across these diodes is 70.7 volts. This in turn will cause a charge transfer from the display conductor tap-off points to the capacitors 704 through the on diodes. The second, third, sixth, seventh, and eighth capacitors will thus charge up to zero volts and the first, fourth, and fifth capacitors will remain at −70 volts while the load driver 715 asserts −70 volts at the capacitor cathodes. Thus, while the load driver 715 asserts a low voltage on the cathodes of capacitors 704, the capacitors are charged to the voltage corresponding to the respective voltage of the pulse train illustrated by waveform 1000. When load driver 715 transitions the cathodes of the capacitors 704 from −70 volts to zero volts as shown at time point 1024, the anodes of the capacitors 704 will also be shifted upward by 70 volts as illustrated by waveform 1006. Thus, the first, fourth, and fifth capacitors will be charged at zero volts and the second, third, sixth, seventh, and eighth capacitors will be charged at 70 volts to correspond to the pulse train that was shifted on the display conductor 740 during time period $W_D$. These voltage levels are now applied to the column conductors and thus selected row pixels while the next pulse train is being shifted down display conductor 740.

Note that load driver 715 asserts a low voltage (in this example −70 volts) for a period of time $W_C$ which is set to be approximately less than or equal to the propagation time between adjacent taps on display conductor 740. This is so that a charge pulse propagating down display conductor 740 which also has a width approximately equal to the propagation delay between taps does not spill over to the next tap while the load driver 715 is driving the load voltage of −70 volts. During the time that the load driver 715 and clear driver 725 are asserting their respective high voltages, the diodes 702 are off or reversed biased to isolate the column conductor 770 from the display conductor 740. This allows the charge from capacitors 704 to be applied to the column conductors 770 while the next pulse train is being shifted on display conductor 740. As mentioned above, before the next pulse train is loaded onto the capacitors 704 any residual capacitor charge is cleared by clear driver 725 asserting a low voltage on the cathodes of the diodes 706 as illustrated by waveform 1002. The width $W_E$ of this clear pulse is illustrated to be approximately equal to the load pulse width $W_C$. However, there is not necessarily a direct correspondence between these pulse widths. For example, since some charge is dissipated from the capacitors by the pixel loads, the clear pulse width $W_E$ may be shorter than the load pulse width $W_C$.

It may be desirable to maximize the clear and load pulse widths to reduce the peak sinking current capability required of clear driver 725 and load driver 715 within the constraints of the display timing. For example, an 853×480 display may allow only 2.5 microseconds per row. If all 853 columns were simultaneously addressed every 2.5 microseconds, the video waveform pulse width $W_T$ and the load pulse width $W_C$ would be approximately 2.5 $\mu$s/853=2.9 ns. In this example, if a zero to 70 volt column pulse for 2.5 microseconds is desired into a load drawing 100 microamps and the drive pulse cannot droop more than 10 volts to properly activate a pixel, a 25 pf capacitor for capacitor 704 would be required as calculated from I=C*dV/dT, where I=100 $\mu$A, dV=10V, dT=2.5 $\mu$s. Note that these values are merely an example for one particular display. Using the 2.9 nanosecond pulse width and the 25 picofarad capacitance values calculated above, the load driver 715, for example, may have to sink 515 amps when asserting the load signal to capacitor 704 worse case.

Figure 27:
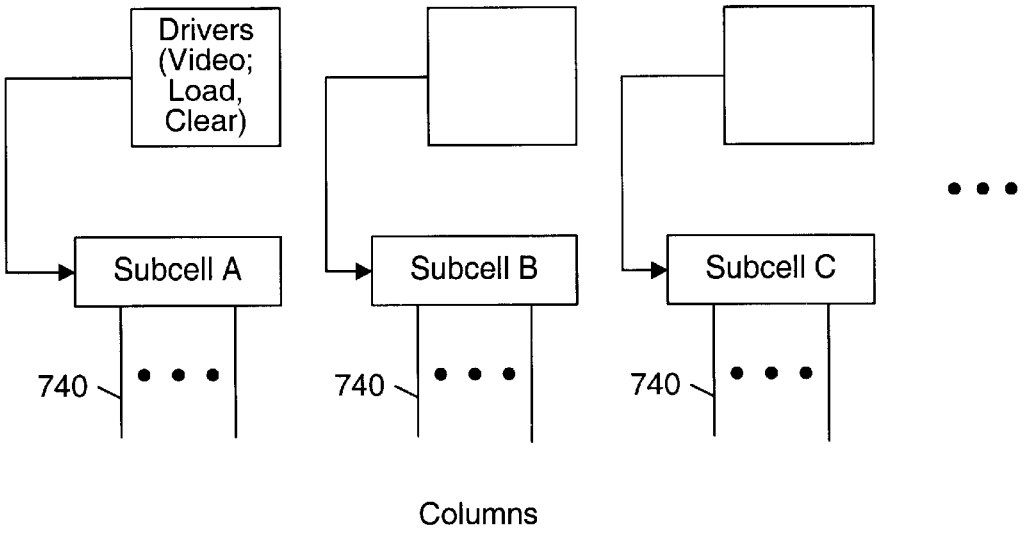
FIG. 27 depicts sub-cell units column and display conductors.

It may not be feasible for the drivers to sink such a large current as calculated above. A solution to this problem is to break the column conductor 770 and display conductor 740 into a number of sub-cell units as illustrated in FIG. 27. For example, the 853 columns may be divided into 54 sub-cells with approximately 16 taps and column conductors per sub-cell. Thus, in such a system there would be 54 display conductors 740 each having 16 tap-off points and column conductors. Separate drivers may be provided for each sub-cell. This sub-cell architecture may reduce the current which the load driver 715, for example, must sink to 180 milliamps peak for the worst case where all columns are at the high voltage. In this example, the video pulse train pulse width and the load pulse width may be 156 ns and each driver must sink current for only 16 loads. The sub-cell architecture allows the current sink capacity of the drivers to be traded off against the number of sub-cells and the number of drivers. The greater the sub-cell division the less current sink capacity required by each driver. Note also that a one-to-one correlation of drivers to sub-cells is not necessarily required. For example, each sub-cell may have its own load driver, but several sub-cells may share a clear driver. In the above example the actual power dissipated by the load driver, for example, may be low because of the low duty cycle of the load cycle (156 nanoseconds divided by 2.5 microseconds=6%). The sub-cell architecture allows the column groupings and number of drivers to be adjusted to meet the desired tradeoff between number of drivers and driver capacity.

Figure 28:
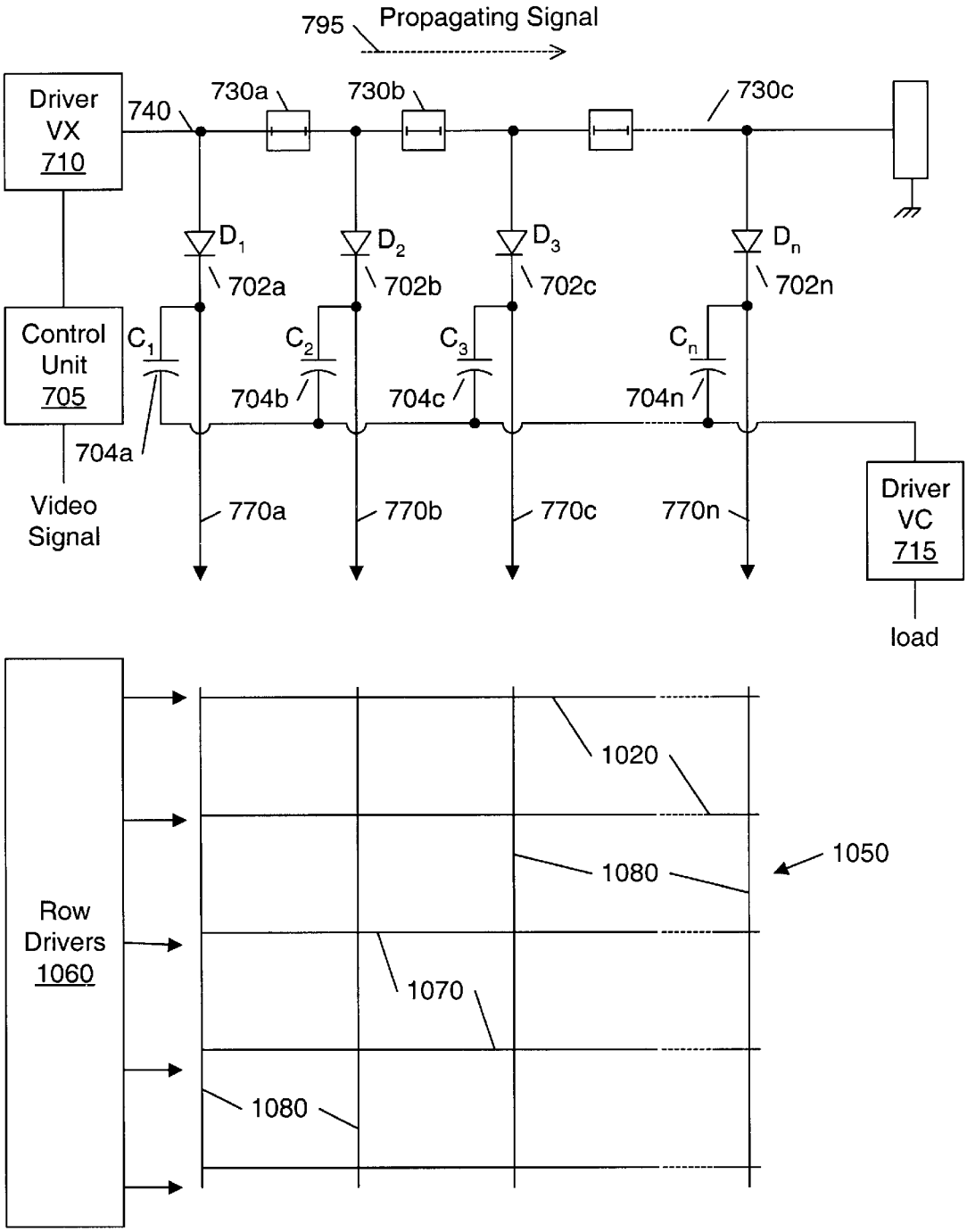
FIG. 28 illustrates the parallel column driving mechanism in FIGS. 22–27 for a display matrix.

Turning now to FIG. 28, the parallel column driving mechanism described above in FIGS. 22–27 is illustrated for a display matrix 1050 in which rows are selected by row driver(s) 1060. Note that row driver 1060 may be any suitable row selection/driving mechanism, such as the beat frequency techniques described above or individual row driver techniques, etc. Row driver 1060 selects one row at a time from top to bottom. As each row 1070 is selected, all of the columns 1080 are driven approximately simultaneously in parallel with voltage levels corresponding to video data for the selected row. During this time a new video pulse train is propagated down display conductor 740, and when the next row is selected, this new pulse train is driven in parallel on columns 1080.

Figure 29:
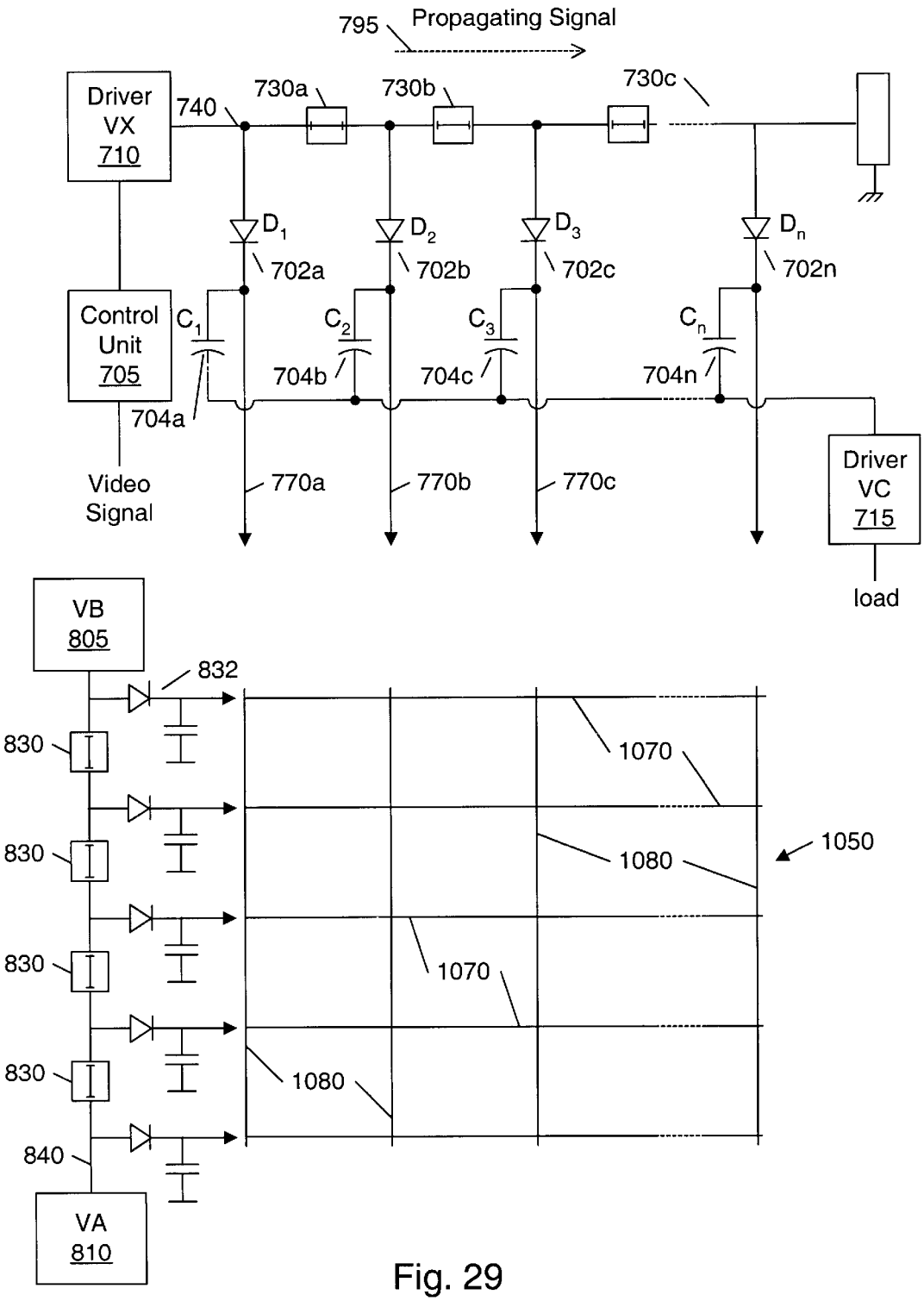
FIG. 29 illustrates an embodiment in which rows are selected by a beat frequency method and columns are driven by a parallel column drive method.

Turning now to FIG. 29, an implementation is illustrated in which the rows are selected by the beat frequency method described above and the columns are driven by the parallel column drive method described above. The rows are addressed one at a time according to where on second display conductor 840 the row address signals driven by drivers 805 and 810 combine their respective amplitude to the appropriate voltage to select a row. As described above, the pulse width of the row address signals is approximately equal to the propagation delay between adjacent row taps, and the period of the row signals is approximately equal to the propagation delay on second display condcutor 740 from the first row tap-off point through the last row tap-off point. The rate at which the addressed row changes from one row to another is proportional to the frequency difference between the row address signal driven by driver 805 and the row address signal driven by driver 810. Diodes and/or capacitors 832 may be included on the row conductors if necessary, for rectifying for example. Also, note that row and/or column terminators, individual pixel elements, etc., are not illustrated for clarity.

As a row 1070 is selected, voltages are provided on columns 1080 by column conductors 770, as described above. The load driver 715 drive a high load voltage to the capacitor 704 cathodes and diodes 702 are reversed biased (or off) so that the charge stored on capacitors 704 supplies a voltage to columns 1080. Depending upon the supplied voltage level, pixels along the selected row are turned on or off. Note that the columns are all supplied with the voltages (addressed) approximately simultaneously in parallel for the selected pixel row. Shortly before the next row is selected residual charge may be cleared from the columns and capacitors 704 (using, e.g., a clear driver and diodes as described in FIG. 25) and load driver 715 then may drive a low voltage on the load signal to capacitors 704 cathodes to load the next series of row pixel voltages, as described above.

The preferred embodiments have been described with respect to addressing any of M×N pixel elements arrayed in M rows and N columns in a display. In addition to the display types referred to earlier herein, the invention also has applicability with various emissive and reflective displays including electroluminescent units, light emitting diode units, micro-mirror units, among others. The present invention may be used with other devices that rely on addressed arrays, include imaging devices such as CCD video cameras, printers, touch screens, etc. Further, the present invention may be used to address any M×N addressable elements that require or implement selectability functions for the purpose of pointing, saving, loading, storing, retrieving, arranging, and displaying. Further, the present invention may also be used to address any of M×N storage cells in an array of RAM memory elements, or indeed to address other selectable elements similarly arrayed. It will be appreciated by those skilled in the art having the benefit of this disclosure that the forms and elements of the invention shown and described are to be taken as exemplary, presently preferred embodiments. Various modifications and changes may be made without departing from the spirit and scope of the invention as set forth in the claims. It is intended that the following claims be interpreted to embrace all such modifications and changes.

What claimed is:

1. A display driving apparatus, comprising:

a video driver for driving a video signal on a first display conductor;

a plurality of first diodes, wherein the anode of each first diode is connected to a separate one of a plurality of tap-off points on said first display conductor;

a plurality of capacitors, wherein the anode of each capacitor is connected to a separate one of a plurality of column conductors, wherein each one of said column conductors is connected to the cathode of a separate one of said first diodes; and a load driver for driving a load signal to the cathodes of said capacitors, wherein a charge corresponding to said video signal at each said tap-off point is transferred to each respective capacitor when said load signal is in a first state, and wherein said charge is supplied from each said capacitor to each respective column conductor when said load signal is in a second state.

2. The apparatus as recited in claim 1, wherein said video signal comprises a series of voltage pulses, wherein each one of said voltage pulse represents whether a display element on a selected row of display elements should be on or off.

3. The apparatus as recited in claim 2, wherein the propagation delay on said first display conductor between adjacent tap-off points is approximately the same for each pair of adjacent tap-off points, and wherein the pulse width of each of said voltage pulses is approximately equal to the propagation delay between adjacent tap-off points.

4. The apparatus as recited in claim 3, wherein in said first state said load signal is driven at a low voltage for approximately equal to or less than said propagation delay between adjacent tap-off points.

5. The apparatus as recited in claim 4, wherein in said second state said load signal is driven at a high voltage relative to said low voltage.

6. The apparatus as recited in claim 2, wherein a different series of voltage pulses is driven on said first display conductor at a period approximately equal to the propagation delay of said first display conductor from a first tap-off point through a last tap-off point on said first display conductor, wherein each said series of voltage pulses corresponds to a different row of display elements.

7. The apparatus as recited in claim 1, wherein during said second state said column conductors are isolated from said first display conductor by said first diodes.

8. The apparatus as recited in claim 7, wherein said video signal comprises a series of voltage pulses, and wherein during said second state a new series of voltage pulses is driven on said first display conductor while charge from a previous series of voltage pulses is transferred to said capacitors.

9. The apparatus as recited in claim 1, wherein said video signal comprises a voltage waveform in which a low video signal voltage corresponds to an "off" pixel state and a high video signal voltage corresponds to an "on" pixel state.

10. The apparatus as recited in claim 9, wherein the voltage differential from said low video signal voltage to said high video signal voltage is approximately equal to the voltage differential between a low column voltage and a high column voltage on said column conductors.

11. The apparatus as recited in claim 10, wherein said load signal transitions between said first state and said second state, wherein said low column voltage or said high column voltage is supplied to said columns conductors by said capacitors during said second state, wherein a low column voltage is supplied if a low video signal voltage was present on the corresponding said tap-off point during a just prior first state and a high column voltage is supplied if a high video signal voltage was present on the corresponding said tap-off point during the just prior first state.

12. The apparatus a recited in claim 11, wherein said high column voltage is sufficient to activate pixels on a selected row of pixels, and wherein said low column voltage is not sufficient to activate pixels on the selected row of pixels.

13. The apparatus as recited in claim 9, wherein said load driver drives said load signal to a low load voltage during said first state and to a high load voltage during said second state, wherein said low video signal voltage and said high video signal voltage are higher than said low load voltage and said high load voltage respectively by a turn-on voltage of said first diodes.

14. The apparatus as recited in claim 1, wherein said capacitors are formed by portions of a conductor trace for said load signal patterned over said column conductors.

15. The apparatus as recited in claim 1, further comprising a clear driver for driving a clear signal to discharge said capacitors.

16. The apparatus as recited in claim 15, further comprising a plurality of second diodes, wherein the anode of each said second diode is connected to a separate one of said column conductors, and wherein the cathode of each said second diode is connected to said clear signal.

17. The apparatus as recited in claim 15, wherein said video signal comprises a series of voltage pulses, wherein each one of said voltage pulse represents whether a display element on a selected row of display elements should be on or off, and wherein said load signal transitions between said first state and said second state each time a new series of voltage pulses is propagated on said first display conductor.

18. The apparatus as recited in claim 17, wherein said clear signal is driven to a low voltage to discharge said capacitors before each transition of said load signal from said second state to said first state.

19. The apparatus as recited in claim 1, further comprising:

a second display conductor;

a series of row conductors coupled to said second display conductor;

a first row driver for outputting a first row addressing signal at a first frequency at a first end of said second display conductor; and a second row driver for outputting a second row addressing signal at a second frequency at a second end of said second display conductor;

wherein said first and second row addressing signal combine to address one row at a time, wherein display elements coupled between an addressed one of row conductors and said column conductors are activated according to said charged supplied to said column conductors.

20. The apparatus as recited in claim 19, wherein said row conductors are addressed one after another at an address rate proportional to the difference between said first and second frequencies.

21. The apparatus as recited in claim 1, wherein said video driver, first diodes, and capacitors are repeated for a plurality of column sub-cells, wherein a different said video driver drives a different video signal for each sub-cell, and wherein the charge corresponding to each video signal is transferred to each respective column in parallel for all said sub-cells.

22. The apparatus as recited in claim 21, wherein said load driver is repeated for each sub-cell so that each sub-cell has a different load driver.

23. The apparatus as recited in claim 22, wherein the current capacity required for each load driver is proportional to the number of sub-cells.

24. The apparatus as recited in claim 21, wherein the current capacity required for each video driver is proportional to the number of sub-cells.

* * * * *

UNITED STATES PATENT AND TRADEMARK OFFICE

CERTIFICATE OF CORRECTION

PATENT NO. : 6,456,281 B1
DATED : September 24, 2002
INVENTOR(S) : Abraham Rindal It is certified that error appears in the above-identified patent and that said Letters Patent is hereby corrected as shown below:

Column 25,
Line 7, please delete “a” and insert -- as -- therein.

Signed and Sealed this

Eleventh Day of February, 2003

JAMES E. ROGAN
*Director of the United States Patent and Trademark Office*